US012331664B2

(12) United States Patent
Mallinak et al.

(10) Patent No.: US 12,331,664 B2
(45) Date of Patent: Jun. 17, 2025

(54) WASTE HEAT INTEGRATION INTO PUMPED THERMAL ENERGY STORAGE

(71) Applicant: Supercritical Storage Company, Inc., Akron, OH (US)

(72) Inventors: Jason A. Mallinak, Akron, OH (US); Timothy J. Held, Akron, OH (US); Jason D. Miller, Hudson, OH (US)

(73) Assignee: Supercritical Storage Company, Inc., Akron, OH (US)

( * ) Notice: Subject to any disclaimer, the term of this patent is extended or adjusted under 35 U.S.C. 154(b) by 0 days.

(21) Appl. No.: 18/433,722

(22) Filed: Feb. 6, 2024

(65) Prior Publication Data

US 2024/0309781 A1 Sep. 19, 2024

Related U.S. Application Data

(60) Provisional application No. 63/443,775, filed on Feb. 7, 2023.

(51) Int. Cl.

| | |
|---|---|
| ***F01K 3/12*** | (2006.01) |
| ***F01K 3/18*** | (2006.01) |
| ***F01K 25/10*** | (2006.01) |

(52) U.S. Cl.

CPC ..... *F01K 3/12* (2013.01); *F01K 3/185* (2013.01); *F01K 25/103* (2013.01)

(58) Field of Classification Search

CPC .... F02C 6/14; F02C 1/10; F28D 20/00; F01K 3/12; F01K 3/185; F01K 25/103

See application file for complete search history.

(56) References Cited

U.S. PATENT DOCUMENTS

| | | | |
|---|---|---|---|
| 1,433,883 | A | 10/1922 | Friderich |
| 1,969,526 | A | 2/1934 | Rosch |

(Continued)

FOREIGN PATENT DOCUMENTS

| | | | |
|---|---|---|---|
| CA | 20140096521 | A1 | 4/2014 |
| CN | 1165238 | A | 11/1997 |

(Continued)

OTHER PUBLICATIONS

Alpy, N., et al., "French Atomic Energy Commission views as regards SCO2 Cycle Development priorities and related R&D approach," Presentation, Symposium on SCO2 Power Cycles, Apr. 29-30, 2009, Troy, NY, 20 pages.

(Continued)

*Primary Examiner* — Shafiq Mian

(74) *Attorney, Agent, or Firm* — Nolte Lackenbach Siegel; N. Alexander Nolte

(57) ABSTRACT

A technique increases the round-trip efficiency ("RTE") of a pumped thermal energy storage system by changing the coefficient of performance ("COP") and efficiency of the cycles by changing the temperature ratios of each, which is accomplished by using two separate low temperature reservoirs ("LTRs") that are at different temperatures. More particularly, the disclosed technique accomplishes this by using a low-temperature thermal reservoir during the charging process that is at a higher temperature than the generating cycle's low-temperature thermal reservoir. The low-temperature thermal reservoirs are "decoupled" and "independently existing", in that their temperature and utilization are independent of one another. In general, decoupled and independently existing reservoirs may also be different in their independent reservoir media, reservoir location, and heat exchangers.

20 Claims, 3 Drawing Sheets

(56) References Cited

U.S. PATENT DOCUMENTS 2,575,478 A 11/1951 Wilson
2,634,375 A 4/1953 Guimbal
2,691,280 A 10/1954 Albert
3,095,274 A 6/1963 Crawford
3,105,748 A 10/1963 Stahl
3,118,277 A 1/1964 Wormser
3,237,403 A 3/1966 Feher
3,277,955 A 10/1966 Laszlo
3,310,954 A 3/1967 Sijtstra et al.
3,401,277 A 9/1968 Larson
3,620,584 A 11/1971 Rosensweig
3,622,767 A 11/1971 Koepcke
3,630,022 A 12/1971 Jubb
3,736,745 A 6/1973 Karig
3,772,879 A 11/1973 Engdahl
3,791,137 A 2/1974 Jubb
3,828,610 A 8/1974 Swearingen
3,830,062 A 8/1974 Morgan et al.
3,831,381 A 8/1974 Swearingen
3,939,328 A 2/1976 Davis
3,971,211 A 7/1976 Wethe
3,977,197 A 8/1976 Brantley, Jr.
3,982,379 A 9/1976 Gilli et al.
3,986,359 A 10/1976 Manning et al.
3,991,588 A 11/1976 Laskaris
3,998,058 A 12/1976 Park
4,003,786 A 1/1977 Cahn
4,005,580 A 2/1977 Swearingen
4,009,575 A 3/1977 Hartman, Jr.
4,015,962 A 4/1977 Tompkins
4,029,255 A 6/1977 Heiser
4,030,312 A 6/1977 Wallin
4,037,413 A 7/1977 Heller et al.
4,049,407 A 9/1977 Bottum
4,070,870 A 1/1978 Bahel
4,071,897 A 1/1978 Groves, Jr. et al.
4,089,744 A 5/1978 Cahn
4,099,381 A 7/1978 Rappoport
4,110,987 A 9/1978 Cahn et al.
4,119,140 A 10/1978 Cates
4,150,547 A 4/1979 Hobson
4,152,901 A 5/1979 Munters
4,164,848 A 8/1979 Gilli
4,164,849 A 8/1979 Mangus
4,170,435 A 10/1979 Swearingen
4,178,762 A 12/1979 Binstock et al.
4,182,960 A 1/1980 Reuyl
4,183,220 A 1/1980 Shaw
4,198,827 A 4/1980 Terry et al.
4,208,882 A 6/1980 Lopes
4,221,185 A 9/1980 Scholes
4,233,085 A 11/1980 Roderick
4,236,869 A 12/1980 Laurello
4,245,476 A 1/1981 Shaw
4,248,049 A 2/1981 Briley
4,257,232 A 3/1981 Bell
4,285,203 A 8/1981 Vakil
4,287,430 A 9/1981 Guido
4,336,692 A 6/1982 Ecker
4,347,711 A 9/1982 Noe
4,347,714 A 9/1982 Kinsell
4,364,239 A 12/1982 Chapelle et al.
4,372,125 A 2/1983 Dickenson
4,374,467 A 2/1983 Briley
4,384,568 A 5/1983 Palmatier
4,390,082 A 6/1983 Swearingen
4,391,101 A 7/1983 Labbe
4,420,947 A 12/1983 Yoshino
4,428,190 A 1/1984 Bronicki
4,433,554 A 2/1984 Rojey
4,439,687 A 3/1984 Wood
4,439,994 A 4/1984 Briley
4,445,180 A 4/1984 Davis
4,448,033 A 5/1984 Briccetti
4,450,363 A 5/1984 Russell
4,455,836 A 6/1984 Binstock
4,467,609 A 8/1984 Loomis
4,467,621 A 8/1984 O'Brien
4,471,622 A 9/1984 Kuwahara
4,475,353 A 10/1984 Lazare
4,489,562 A 12/1984 Snyder
4,489,563 A 12/1984 Kalina
4,498,289 A 2/1985 Osgerby
4,507,936 A 4/1985 Yoshino
4,516,403 A 5/1985 Tanaka
4,538,960 A 9/1985 Iino et al.
4,549,401 A 10/1985 Spliethoff
4,555,905 A 12/1985 Endou
4,558,228 A 12/1985 Larjola
4,573,321 A 3/1986 Knaebel
4,578,953 A 4/1986 Krieger et al.
4,589,255 A 5/1986 Martens
4,636,578 A 1/1987 Feinberg
4,665,975 A 5/1987 Johnston
4,674,297 A 6/1987 Vobach
4,694,189 A 9/1987 Haraguchi
4,697,981 A 10/1987 Brown et al.
4,700,543 A 10/1987 Krieger
4,730,977 A 3/1988 Haaser
4,756,162 A 7/1988 Dayan
4,765,143 A 8/1988 Crawford
4,773,212 A 9/1988 Griffin
4,798,056 A 1/1989 Franklin
4,813,242 A 3/1989 Wicks
4,821,514 A 4/1989 Schmidt
4,867,633 A 9/1989 Gravelle
4,884,942 A 12/1989 Pennink
4,888,954 A 12/1989 Silvestri, Jr.
4,892,459 A 1/1990 Guelich
4,986,071 A 1/1991 Voss
4,993,483 A 2/1991 Harris
5,000,003 A 3/1991 Wicks
5,050,375 A 9/1991 Dickinson
5,080,047 A 1/1992 Williams et al.
5,083,425 A 1/1992 Hendriks et al.
5,098,194 A 3/1992 Kuo et al.
5,102,295 A 4/1992 Pope
5,104,284 A 4/1992 Hustak, Jr.
5,164,020 A 11/1992 Wagner
5,176,321 A 1/1993 Doherty
5,203,159 A 4/1993 Koizumi et al.
5,228,310 A 7/1993 Vandenberg
5,248,239 A 9/1993 Andrews
5,291,509 A 3/1994 Mizoguchi et al.
5,291,960 A 3/1994 Brandenburg
5,320,482 A 6/1994 Palmer et al.
5,321,944 A 6/1994 Bronicki et al.
5,335,510 A 8/1994 Rockenfeller
5,358,378 A 10/1994 Holscher
5,360,057 A 11/1994 Rockenfeller
5,384,489 A 1/1995 Bellac
5,392,606 A 2/1995 Labinov
5,440,882 A 8/1995 Kalina
5,444,972 A 8/1995 Moore
5,483,797 A 1/1996 Rigal et al.
5,487,822 A 1/1996 Demaray et al.
5,488,828 A 2/1996 Brossard
5,490,386 A 2/1996 Keller
5,503,222 A 4/1996 Dunne
5,531,073 A 7/1996 Bronicki
5,538,564 A 7/1996 Kaschmitter
5,542,203 A 8/1996 Luoma
5,544,479 A 8/1996 Yan et al.
5,570,578 A 11/1996 Saujet
5,588,298 A 12/1996 Kalina
5,600,967 A 2/1997 Meckler
5,609,465 A 3/1997 Batson et al.
5,634,340 A 6/1997 Grennan
5,647,221 A 7/1997 Garris, Jr.
5,649,426 A 7/1997 Kalina
5,676,382 A 10/1997 Dahlheimer
5,680,753 A 10/1997 Hollinger
5,685,152 A 11/1997 Sterling
5,704,206 A 1/1998 Kaneko et al.

(56) References Cited

U.S. PATENT DOCUMENTS

| | | | |
|---|---|---|---|
| 5,738,164 | A | 4/1998 | Hildebrand |
| 5,754,613 | A | 5/1998 | Hashiguchi |
| 5,771,700 | A | 6/1998 | Cochran |
| 5,782,081 | A | 7/1998 | Pak et al. |
| 5,789,822 | A | 8/1998 | Calistrat |
| 5,799,490 | A | 9/1998 | Bronicki et al. |
| 5,813,215 | A | 9/1998 | Weisser |
| 5,833,876 | A | 11/1998 | Schnur et al. |
| 5,862,666 | A | 1/1999 | Liu |
| 5,873,260 | A | 2/1999 | Linhardt |
| 5,874,039 | A | 2/1999 | Edelson |
| 5,884,470 | A | 3/1999 | Frutschi |
| 5,894,836 | A | 4/1999 | Wu |
| 5,899,067 | A | 5/1999 | Hageman |
| 5,901,783 | A | 5/1999 | Dobak, III et al. |
| 5,903,060 | A | 5/1999 | Norton |
| 5,918,460 | A | 7/1999 | Connell |
| 5,941,238 | A | 8/1999 | Tracy |
| 5,943,869 | A | 8/1999 | Cheng |
| 5,946,931 | A | 9/1999 | Lomax |
| 5,954,342 | A | 9/1999 | Mikhalev et al. |
| 5,973,050 | A | 10/1999 | Johnson |
| 6,037,683 | A | 3/2000 | Lulay |
| 6,041,604 | A | 3/2000 | Nicodemus |
| 6,058,695 | A | 5/2000 | Ranasinghe |
| 6,058,930 | A | 5/2000 | Shingleton |
| 6,059,450 | A | 5/2000 | McClure |
| 6,062,815 | A | 5/2000 | Holt |
| 6,065,280 | A | 5/2000 | Ranasinghe |
| 6,066,797 | A | 5/2000 | Toyomura |
| 6,070,405 | A | 6/2000 | Jerye |
| 6,082,110 | A | 7/2000 | Rosenblatt |
| 6,105,368 | A | 8/2000 | Hansen |
| 6,112,547 | A | 9/2000 | Spauschus |
| 6,129,507 | A | 10/2000 | Ganelin |
| 6,158,237 | A | 12/2000 | Riffat |
| 6,164,655 | A | 12/2000 | Bothien |
| 6,202,782 | B1 | 3/2001 | Hatanaka |
| 6,223,846 | B1 | 5/2001 | Schechter |
| 6,233,938 | B1 | 5/2001 | Nicodemus |
| 6,233,955 | B1 | 5/2001 | Egara |
| 6,282,900 | B1 | 9/2001 | Bell |
| 6,282,917 | B1 | 9/2001 | Mongan |
| 6,295,818 | B1 | 10/2001 | Ansley |
| 6,298,653 | B1 | 10/2001 | Lawlor |
| 6,299,690 | B1 | 10/2001 | Mongeon |
| 6,341,781 | B1 | 1/2002 | Matz |
| 6,347,520 | B1 | 2/2002 | Ranasinghe et al. |
| 6,374,630 | B1 | 4/2002 | Jones |
| 6,393,851 | B1 | 5/2002 | Wightman |
| 6,432,320 | B1 | 8/2002 | Bonsignore |
| 6,434,955 | B1 | 8/2002 | Ng |
| 6,442,951 | B1 | 9/2002 | Maeda |
| 6,446,425 | B1 | 9/2002 | Lawlor |
| 6,446,465 | B1 | 9/2002 | Dubar |
| 6,463,730 | B1 | 10/2002 | Keller |
| 6,484,490 | B1 | 11/2002 | Olsen |
| 6,490,812 | B1 | 12/2002 | Bennett et al. |
| 6,530,224 | B1 | 3/2003 | Conchieri |
| 6,539,720 | B2 | 4/2003 | Rouse et al. |
| 6,539,728 | B2 | 4/2003 | Korin |
| 6,563,855 | B1 | 5/2003 | Nishi et al. |
| 6,571,548 | B1 | 6/2003 | Bronicki |
| 6,581,384 | B1 | 6/2003 | Benson |
| 6,588,499 | B1 | 7/2003 | Fahlsing |
| 6,598,397 | B2 | 7/2003 | Hanna |
| 6,644,062 | B1 | 11/2003 | Hays |
| 6,657,849 | B1 | 12/2003 | Andresakis |
| 6,668,554 | B1 | 12/2003 | Brown |
| 6,684,625 | B2 | 2/2004 | Kline |
| 6,695,974 | B2 | 2/2004 | Withers |
| 6,715,294 | B2 | 4/2004 | Anderson |
| 6,734,585 | B2 | 5/2004 | Tornquist |
| 6,735,948 | B1 | 5/2004 | Kalina |
| 6,739,142 | B2 | 5/2004 | Korin |
| 6,751,959 | B1 | 6/2004 | McClanahan et al. |
| 6,769,256 | B1 | 8/2004 | Kalina |
| 6,799,892 | B2 | 10/2004 | Leuthold |
| 6,808,179 | B1 | 10/2004 | Bhattacharyya |
| 6,810,335 | B2 | 10/2004 | Lysaght |
| 6,817,185 | B2 | 11/2004 | Coney |
| 6,857,268 | B2 | 2/2005 | Stinger |
| 6,892,522 | B2 | 5/2005 | Brasz et al. |
| 6,910,334 | B2 | 6/2005 | Kalina |
| 6,918,254 | B2 | 7/2005 | Baker |
| 6,921,518 | B2 | 7/2005 | Johnston |
| 6,941,757 | B2 | 9/2005 | Kalina |
| 6,960,839 | B2 | 11/2005 | Zimron |
| 6,960,840 | B2 | 11/2005 | Willis |
| 6,962,054 | B1 | 11/2005 | Linney |
| 6,962,056 | B2 | 11/2005 | Brasz et al. |
| 6,964,168 | B1 | 11/2005 | Pierson |
| 6,968,690 | B2 | 11/2005 | Kalina |
| 6,986,251 | B2 | 1/2006 | Radcliff |
| 7,013,205 | B1 | 3/2006 | Hafner et al. |
| 7,021,060 | B1 | 4/2006 | Kalina |
| 7,022,294 | B2 | 4/2006 | Johnston |
| 7,033,553 | B2 | 4/2006 | Johnston |
| 7,036,315 | B2 | 5/2006 | Kang |
| 7,041,272 | B2 | 5/2006 | Keefer |
| 7,047,744 | B1 | 5/2006 | Robertson |
| 7,048,782 | B1 | 5/2006 | Couch |
| 7,062,913 | B2 | 6/2006 | Christensen |
| 7,096,665 | B2 | 8/2006 | Stinger |
| 7,096,679 | B2 | 8/2006 | Manole |
| 7,124,587 | B1 | 10/2006 | Linney |
| 7,174,715 | B2 | 2/2007 | Armitage |
| 7,194,863 | B2 | 3/2007 | Ganev |
| 7,197,876 | B1 | 4/2007 | Kalina |
| 7,200,996 | B2 | 4/2007 | Cogswell |
| 7,234,314 | B1 | 6/2007 | Wiggs |
| 7,249,588 | B2 | 7/2007 | Russell |
| 7,278,267 | B2 | 10/2007 | Yamada |
| 7,279,800 | B2 | 10/2007 | Bassett |
| 7,287,381 | B1 | 10/2007 | Pierson |
| 7,305,829 | B2 | 12/2007 | Mirolli |
| 7,313,926 | B2 | 1/2008 | Gurin |
| 7,340,894 | B2 | 3/2008 | Miyahara et al. |
| 7,340,897 | B2 | 3/2008 | Zimron |
| 7,343,746 | B2 | 3/2008 | Pierson |
| 7,406,830 | B2 | 8/2008 | Valentian |
| 7,416,137 | B2 | 8/2008 | Hagen et al. |
| 7,453,242 | B2 | 11/2008 | Ichinose |
| 7,458,217 | B2 | 12/2008 | Kalina |
| 7,458,218 | B2 | 12/2008 | Kalina |
| 7,464,551 | B2 | 12/2008 | Althaus et al. |
| 7,469,542 | B2 | 12/2008 | Kalina |
| 7,516,619 | B2 | 4/2009 | Pelletier |
| 7,600,394 | B2 | 10/2009 | Kalina |
| 7,621,133 | B2 | 11/2009 | Tomlinson |
| 7,654,354 | B1 | 2/2010 | Otterstrom |
| 7,665,291 | B2 | 2/2010 | Anand et al. |
| 7,665,304 | B2 | 2/2010 | Sundel |
| 7,673,681 | B2 | 3/2010 | Vinegar et al. |
| 7,685,820 | B2 | 3/2010 | Litwin et al. |
| 7,685,821 | B2 | 3/2010 | Kalina |
| 7,730,713 | B2 | 6/2010 | Nakano |
| 7,735,335 | B2 | 6/2010 | Uno |
| 7,770,376 | B1 | 8/2010 | Brostmeyer |
| 7,775,758 | B2 | 8/2010 | Legare |
| 7,827,791 | B2 | 11/2010 | Pierson |
| 7,838,470 | B2 | 11/2010 | Shaw |
| 7,841,179 | B2 | 11/2010 | Kalina |
| 7,841,306 | B2 | 11/2010 | Myers |
| 7,854,587 | B2 | 12/2010 | Ito |
| 7,866,157 | B2 | 1/2011 | Ernst |
| 7,900,450 | B2 | 3/2011 | Gurin |
| 7,950,230 | B2 | 5/2011 | Nishikawa |
| 7,950,243 | B2 | 5/2011 | Gurin |
| 7,971,424 | B2 | 7/2011 | Masada |
| 7,972,529 | B2 | 7/2011 | Machado |
| 7,997,076 | B2 | 8/2011 | Ernst |
| 8,015,790 | B2 | 9/2011 | Zhang et al. |
| 8,096,128 | B2 | 1/2012 | Held et al. |

(56) References Cited

U.S. PATENT DOCUMENTS 8,099,198 B2 1/2012 Gurin
8,099,972 B2 1/2012 Dupraz
8,146,360 B2 4/2012 Myers
8,235,647 B2 8/2012 Pisseloup et al.
8,281,593 B2 10/2012 Held
8,289,710 B2 10/2012 Spearing et al.
8,297,065 B2 10/2012 Vaisman et al.
8,375,719 B2 2/2013 Rhodes et al.
8,387,248 B2 3/2013 Rolt et al.
8,419,936 B2 4/2013 Berger et al.
8,544,274 B2 10/2013 Ernst
8,584,463 B2 11/2013 Hemrle et al.
8,613,195 B2 12/2013 Held et al.
8,661,820 B2 3/2014 Mak
8,813,497 B2 8/2014 Hart et al.
8,820,083 B2 9/2014 Davidson et al.
8,869,531 B2 10/2014 Held
8,973,398 B2 3/2015 Coyle
9,038,390 B1 5/2015 Kreuger
9,180,421 B2 11/2015 Kwang et al.
9,523,312 B2 12/2016 Allam et al.
9,638,065 B2 5/2017 Vermeersch et al.
9,810,451 B2 11/2017 O'Donnell et al.
9,845,667 B2 12/2017 Mokheimer et al.
9,874,112 B2 1/2018 Giegel
9,932,861 B2 4/2018 Preuss et al.
10,077,683 B2 9/2018 Close
2001/0015061 A1 8/2001 Viteri et al.
2001/0020444 A1 9/2001 Johnston
2001/0027642 A1 10/2001 Tsuji
2001/0030952 A1 10/2001 Roy
2002/0029558 A1 3/2002 Tamaro
2002/0053196 A1 5/2002 Lerner et al.
2002/0066270 A1 6/2002 Rouse et al.
2002/0078696 A1 6/2002 Korin
2002/0078697 A1 6/2002 Lifson
2002/0082747 A1 6/2002 Kramer
2002/0148225 A1 10/2002 Lewis
2003/0000213 A1 1/2003 Christensen
2003/0061823 A1 4/2003 Alden
2003/0154718 A1 8/2003 Nayar
2003/0182946 A1 10/2003 Sami
2003/0213246 A1 11/2003 Coll et al.
2003/0221438 A1 12/2003 Rane et al.
2004/0011038 A1 1/2004 Stinger
2004/0011039 A1 1/2004 Stinger et al.
2004/0020185 A1 2/2004 Brouillette et al.
2004/0020206 A1 2/2004 Sullivan et al.
2004/0021182 A1 2/2004 Green et al.
2004/0035117 A1 2/2004 Rosen
2004/0083731 A1 5/2004 Lasker
2004/0083732 A1 5/2004 Hanna et al.
2004/0088992 A1 5/2004 Brasz et al.
2004/0097388 A1 5/2004 Brask et al.
2004/0105980 A1 6/2004 Sudarshan et al.
2004/0107700 A1 6/2004 McClanahan et al.
2004/0159110 A1 8/2004 Janssen
2004/0211182 A1 10/2004 Gould
2004/0247211 A1 12/2004 Hamke
2005/0022963 A1 2/2005 Garrabrant et al.
2005/0056001 A1 3/2005 Frutschi
2005/0072182 A1 4/2005 Taniguchi et al.
2005/0096676 A1 5/2005 Gifford, III et al.
2005/0109387 A1 5/2005 Marshall
2005/0118025 A1 6/2005 Hiegemann et al.
2005/0137777 A1 6/2005 Kolavennu et al.
2005/0162018 A1 7/2005 Realmuto et al.
2005/0167169 A1 8/2005 Gering et al.
2005/0183421 A1 8/2005 Vaynberg et al.
2005/0196676 A1 9/2005 Singh et al.
2005/0198959 A1 9/2005 Schubert
2005/0227187 A1 10/2005 Schilling
2005/0252235 A1 11/2005 Critoph et al.
2005/0257812 A1 11/2005 Wright et al.
2005/0262848 A1 12/2005 Joshi et al.
2005/0276685 A1 12/2005 Wiggins et al.
2006/0010868 A1 1/2006 Smith
2006/0060333 A1 3/2006 Chordia et al.
2006/0066113 A1 3/2006 Ebrahim et al.
2006/0080960 A1 4/2006 Rajendran et al.
2006/0112693 A1 6/2006 Sundel
2006/0112702 A1 6/2006 Martin et al.
2006/0182680 A1 8/2006 Keefer et al.
2006/0211871 A1 9/2006 Dai et al.
2006/0213218 A1 9/2006 Uno et al.
2006/0222523 A1 10/2006 Valentian et al.
2006/0225421 A1 10/2006 Yamanaka et al.
2006/0225459 A1 10/2006 Meyer
2006/0249020 A1 11/2006 Tonkovich et al.
2006/0254281 A1 11/2006 Badeer et al.
2007/0001766 A1 1/2007 Ripley et al.
2007/0007771 A1 1/2007 Biddle et al.
2007/0017192 A1 1/2007 Bednarek et al.
2007/0019708 A1 1/2007 Shiflett et al.
2007/0027038 A1 2/2007 Kamimura et al.
2007/0056290 A1 3/2007 Dahm
2007/0089449 A1 4/2007 Gurin
2007/0108200 A1 5/2007 McKinzie, II
2007/0119175 A1 5/2007 Ruggieri et al.
2007/0130952 A1 6/2007 Copen
2007/0151244 A1 7/2007 Gurin
2007/0161095 A1 7/2007 Gurin
2007/0163261 A1 7/2007 Strathman
2007/0195152 A1 8/2007 Kawai et al.
2007/0204620 A1 9/2007 Pronske et al.
2007/0116299 A1 10/2007 Energies
2007/0227472 A1 10/2007 Takeuchi et al.
2007/0234722 A1 10/2007 Kalina
2007/0245733 A1 10/2007 Pierson et al.
2007/0246206 A1 10/2007 Gong et al.
2008/0000225 A1 1/2008 Kalina
2008/0006040 A1 1/2008 Peterson et al.
2008/0010967 A1 1/2008 Griffin et al.
2008/0023666 A1 1/2008 Gurin
2008/0053095 A1 3/2008 Kalina
2008/0066470 A1 3/2008 MacKnight
2008/0134681 A1 6/2008 Nayef et al.
2008/0135253 A1 6/2008 Vinegar et al.
2008/0163618 A1 7/2008 Paul
2008/0163625 A1 7/2008 O'Brien
2008/0173444 A1 7/2008 Stone et al.
2008/0173450 A1 7/2008 Goldberg et al.
2008/0174115 A1 7/2008 Lambirth
2008/0211230 A1 9/2008 Gurin
2008/0217321 A1 9/2008 Vinegar et al.
2008/0250789 A1 10/2008 Myers et al.
2008/0252078 A1 10/2008 Myers
2008/0282702 A1 11/2008 Collins
2008/0282715 A1 11/2008 Aue et al.
2009/0021251 A1 1/2009 Simon
2009/0071156 A1 3/2009 Nishikawa et al.
2009/0085709 A1 4/2009 Meinke
2009/0107144 A1 4/2009 Moghtaderi et al.
2009/0139234 A1 6/2009 Gurin
2009/0139781 A1 6/2009 Straubel
2009/0173337 A1 7/2009 Tamaura et al.
2009/0173486 A1 7/2009 Copeland
2009/0179429 A1 7/2009 Ellis et al.
2009/0180903 A1 7/2009 Martin et al.
2009/0205892 A1 8/2009 Jensen et al.
2009/0211251 A1 8/2009 Peterson et al.
2009/0211253 A1 8/2009 Radcliff et al.
2009/0257902 A1 10/2009 Ernens
2009/0266075 A1 10/2009 Westmeier et al.
2009/0293503 A1 12/2009 Vandor
2009/0320477 A1 12/2009 Juchymenko
2010/0024421 A1 2/2010 Litwin
2010/0077792 A1 4/2010 Gurin
2010/0083662 A1 4/2010 Kalina
2010/0102008 A1 4/2010 Hedberg
2010/0122533 A1 5/2010 Kalina
2010/0143094 A1 6/2010 Pisseloup et al.
2010/0146949 A1 6/2010 Stobart et al.
2010/0146973 A1 6/2010 Kalina

(56) References Cited

U.S. PATENT DOCUMENTS

2010/0156112 A1 6/2010 Held et al.
2010/0162721 A1 7/2010 Welch et al.
2010/0205962 A1 8/2010 Kalina
2010/0212316 A1 8/2010 Waterstripe et al.
2010/0218513 A1 9/2010 Vaisman et al.
2010/0218930 A1 9/2010 Proeschel
2010/0263380 A1 10/2010 Biederman et al.
2010/0287920 A1 11/2010 Duparchy
2010/0287934 A1 11/2010 Glynn et al.
2010/0300093 A1 12/2010 Doty
2010/0319346 A1 12/2010 Ast et al.
2010/0326076 A1 12/2010 Ast et al.
2011/0027064 A1 2/2011 Pal et al.
2011/0030404 A1 2/2011 Gurin
2011/0048012 A1 3/2011 Ernst et al.
2011/0051880 A1 3/2011 Al-Mayahi et al.
2011/0061384 A1 3/2011 Held et al.
2011/0061387 A1 3/2011 Held et al.
2011/0088399 A1 4/2011 Briesch et al.
2011/0100002 A1 5/2011 Muir et al.
2011/0100611 A1 5/2011 Ohler et al.
2011/0113781 A1 5/2011 Frey et al.
2011/0164957 A1 7/2011 Rivas et al.
2011/0179799 A1 7/2011 Allam et al.
2011/0185729 A1 8/2011 Held
2011/0192163 A1 8/2011 Kasuya
2011/0203278 A1 8/2011 Kopecek et al.
2011/0214424 A1 9/2011 Wood
2011/0219760 A1 9/2011 McBride et al.
2011/0259010 A1 10/2011 Bronicki et al.
2011/0270451 A1 11/2011 Sakaguchi et al.
2011/0286724 A1 11/2011 Goodman
2011/0288688 A1 11/2011 Lehan
2011/0299972 A1 12/2011 Morris
2011/0308253 A1 12/2011 Ritter
2012/0042650 A1 2/2012 Ernst et al.
2012/0027688 A1 3/2012 Yin et al.
2012/0047892 A1 3/2012 Held et al.
2012/0055153 A1 3/2012 Murata et al.
2012/0067046 A1 3/2012 Drenik et al.
2012/0067055 A1 3/2012 Held
2012/0047889 A1 4/2012 Yarpour
2012/0111003 A1 5/2012 Kasuya et al.
2012/0125002 A1 5/2012 Lehar et al.
2012/0128463 A1 5/2012 Held
2012/0131918 A1 5/2012 Held
2012/0131919 A1 5/2012 Held
2012/0131920 A1 5/2012 Held
2012/0131921 A1 5/2012 Held
2012/0159922 A1 6/2012 Gurin
2012/0159956 A1 6/2012 Gurin
2012/0167873 A1 7/2012 Venetos et al.
2012/0174558 A1 7/2012 Gurin
2012/0186219 A1 7/2012 Gurin
2012/0240616 A1 9/2012 Ritter et al.
2012/0247134 A1 10/2012 Gurin
2012/0247455 A1 10/2012 Gurin et al.
2012/0255304 A1 10/2012 Li et al.
2012/0261090 A1 10/2012 Durmaz et al.
2012/0261104 A1 10/2012 Kelly et al.
2012/0306206 A1 12/2012 Agrawal et al.
2012/0319410 A1 12/2012 Ambrosek et al.
2013/0019597 A1 1/2013 Kalina
2013/0033037 A1 2/2013 Held et al.
2013/0036736 A1 2/2013 Hart et al.
2013/0074497 A1 3/2013 Mori et al.
2013/0087301 A1 4/2013 Hemrle et al.
2013/0113221 A1 5/2013 Held
2013/0134720 A1 5/2013 Fukasaku et al.
2013/0145759 A1 6/2013 Sonwane et al.
2014/0041387 A1 2/2014 Benson
2014/0090405 A1 4/2014 Held et al.
2014/0096521 A1 4/2014 Held et al.
2014/0102098 A1 4/2014 Bowan et al.
2014/0102103 A1 4/2014 Yamamoto et al.
2014/0150992 A1 6/2014 Koontz et al.
2014/0208750 A1 7/2014 Vermeersch
2014/0208751 A1 7/2014 Bowan
2014/0216034 A1 8/2014 Numata et al.
2014/0223907 A1 8/2014 Fujioka et al.
2014/0224447 A1 8/2014 Reznik et al.
2015/0069758 A1 3/2015 Davidson et al.
2015/0260463 A1* 9/2015 Laughlin ..... F24S 60/10 165/104.31
2015/0369086 A1 12/2015 Johnson et al.
2016/0017759 A1 1/2016 Gayawal et al.
2016/0040557 A1 2/2016 Vermeersch et al.
2016/0102608 A1 4/2016 Lynn
2016/0237904 A1 8/2016 Scarboro et al.
2017/0058202 A1 3/2017 Noureldin et al.
2017/0350658 A1 12/2017 Kerth et al.
2017/0362963 A1 12/2017 Hostler et al.
2018/0187597 A1* 7/2018 Apte ..... H02K 7/1823
2018/0187628 A1 7/2018 Apte
2018/0283222 A1 10/2018 Park et al.
2018/0340712 A1 11/2018 Peter et al.
2019/0017417 A1 1/2019 Cha
2019/0170026 A1 6/2019 Matsukuma et al.
2020/0003081 A1 1/2020 Held
2022/0349355 A1* 11/2022 Apte ..... F01K 13/02

FOREIGN PATENT DOCUMENTS

CN 1432102 A 7/2003
CN 101614139 A 12/2009
CN 202055876 U 11/2011
CN 202544943 U 11/2012
CN 202718721 U 2/2013
DE 2632777 A1 2/1977
DE 19906087 A1 8/2000
DE 10052993 A1 5/2002
DE 102007020086 B3 4/2007
DE 10 2011005722 B3 3/2011
EP 0003980 A1 2/1979
EP 0286565 A2 4/1988
EP 1484489 A2 8/2004
EP 1577549 A1 9/2005
EP 1977174 A2 10/2008
EP 1998013 A2 12/2008
EP 2157317 A2 2/2010
EP 2241737 A1 10/2010
EP 2312129 A1 4/2011
EP 2357324 A2 9/2011
EP 2390473 A1 11/2011
EP 2419621 A1 2/2012
EP 2446122 A1 5/2012
EP 2478201 A1 7/2012
EP 2500530 A1 9/2012
EP 2550436 A1 1/2013
EP 2698506 A1 2/2014
GB 856985 A 12/1960
GB 2010974 A 7/1979
GB 2075608 A 11/1981
JP 58-193051 A 11/1983
JP 60-040707 A 3/1985
JP 61-152914 A 7/1986
JP 01-240705 A 9/1989
JP H03182638 A 8/1991
JP 05-321612 A 12/1993
JP 05-321648 A 12/1993
JP 06-331225 A 11/1994
JP 08-028805 A 2/1996
JP 09-100702 A 4/1997
JP 2641581 B2 5/1997
JP 09-209716 A 8/1997
JP 2858750 B2 12/1998
JP H11-270352 5/1999
JP 2000-257407 A 9/2000
JP 3119718 B2 12/2000
JP 2001-193419 A 7/2001
JP 2002-097965 A 4/2002
JP 2003-529715 A 10/2003
JP 2004-239250 A 8/2004
JP 2004-332626 A 11/2004

(56) References Cited

FOREIGN PATENT DOCUMENTS

| | | | |
|---|---|---|---|
| JP | 2005-030727 | A | 2/2005 |
| JP | 2005-533972 | A1 | 11/2005 |
| JP | 2006-037760 | A | 2/2006 |
| JP | 2006-177266 | A | 7/2006 |
| JP | 2007-198200 | A | 9/2007 |
| JP | 4343738 | B2 | 10/2009 |
| JP | 2011-017268 | A | 1/2011 |
| KR | 100191080 | | 6/1999 |
| KR | 10_2007_0086244 | A | 8/2007 |
| KR | 10-0766101 | B1 | 10/2007 |
| KR | 10-0844634 | A | 7/2008 |
| KR | 10-20100067927 | A | 6/2010 |
| KR | 1020110018769 | A | 2/2011 |
| KR | 1069914 | B1 | 9/2011 |
| KR | 1103549 | B1 | 1/2012 |
| KR | 10-2012-0058582 | A | 6/2012 |
| KR | 2012-0068670 | A | 6/2012 |
| KR | 2012-0128753 | A | 11/2012 |
| KR | 2012-0128755 | A | 11/2012 |
| WO | WO 1991/05145 | A1 | 4/1991 |
| WO | WO 92/12366 | A1 | 7/1992 |
| WO | WO 1996/009500 | A1 | 3/1996 |
| WO | WO 00-71944 | A1 | 11/2000 |
| WO | WO 2001/044658 | A1 | 6/2001 |
| WO | WO 02/090721 | A1 | 11/2002 |
| WO | WO 02/090747 | A2 | 11/2002 |
| WO | WO 2006/060253 | | 6/2006 |
| WO | WO 2006/137957 | A1 | 12/2006 |
| WO | WO 2007/056241 | A2 | 5/2007 |
| WO | WO 2007/079245 | A2 | 7/2007 |
| WO | WO 2007/082103 | A2 | 7/2007 |
| WO | WO 2007/112090 | A2 | 10/2007 |
| WO | WO 2008014774 | A2 | 2/2008 |
| WO | WO 2008/039725 | A2 | 4/2008 |
| WO | WO 2008/101711 | A2 | 8/2008 |
| WO | WO 2009/045196 | A1 | 4/2009 |
| WO | WO 2009/058992 | A2 | 5/2009 |
| WO | WO 2010/006942 | A1 | 2/2010 |
| WO | WO 2010/017981 | A2 | 2/2010 |
| WO | WO 2010/017981 | A3 | 2/2010 |
| WO | WO 2010/074173 | A1 | 7/2010 |
| WO | WO 2010/083198 | A1 | 7/2010 |
| WO | WO 2014/114531 | A1 | 7/2010 |
| WO | WO 2010/121255 | A1 | 10/2010 |
| WO | WO 2010/126980 | A2 | 11/2010 |
| WO | WO 2010/151560 | A1 | 12/2010 |
| WO | WO 2011/017450 | A2 | 2/2011 |
| WO | WO 2011/017476 | A1 | 2/2011 |
| WO | WO 2011/017599 | A1 | 2/2011 |
| WO | WO 2011/034984 | A1 | 3/2011 |
| WO | WO 2011/094294 | A2 | 8/2011 |
| WO | WO 2011/119650 | A2 | 9/2011 |
| WO | WO 2012/036678 | A1 | 3/2012 |
| WO | WO 2012/074905 | A2 | 6/2012 |
| WO | WO 2012/074907 | A2 | 6/2012 |
| WO | WO 2012/074911 | A2 | 6/2012 |
| WO | WO 2012/074940 | A2 | 6/2012 |
| WO | WO 2013/055391 | A1 | 4/2013 |
| WO | WO 2013/059687 | A1 | 4/2013 |
| WO | WO 2013/059695 | A1 | 4/2013 |
| WO | WO 2013/070249 | A1 | 5/2013 |
| WO | WO 2013/074907 | A1 | 5/2013 |
| WO | WO 2014/164620 | A1 | 3/2014 |
| WO | WO 2014/138035 | A1 | 9/2014 |
| WO | WO 2014/159520 | A1 | 10/2014 |
| WO | WO 2016/150455 | A1 | 9/2016 |
| WO | WO 2018/217969 | A1 | 11/2018 |
| WO | WO 2020/90721 | A1 | 7/2020 |

OTHER PUBLICATIONS

Angelino, G., and Invernizzi, C.M., "Carbon Dioxide Power Cycles using Liquid Natural Gas as Heat Sink", Applied Thermal Engineering Mar. 3, 2009, 43 pages.

Bryant, John C., Saari, Henry, and Zanganeh, Kourosh, "An Analysis and Comparison of the Simple and Recompression Supercritical CO2 Cycles" Supercritical CO2 Power Cycle Symposium, May 24-25, 2011, Boulder, CO, 8 pages.

Chapman, Daniel J., Arias, Diego A., "An Assessment of the Supercritical Carbon Dioxide Cycle for Use in a Solar Parabolic Trough Power Plant", Presentation, Abengoa Solar, Apr. 29-30, 2009, Troy, NY, 20 pages.

Chapman, Daniel J., Arias, Diego A., "An Assessment of the Supercritical Carbon Dioxide Cycle for Use in a Solar Parabolic Trough Power Plant", Paper, Abengoa Solar, Apr. 29-30, 2009, Troy, NY, 5 pages.

Chen, Yang, Lundqvist, P., Johansson, A., Platell, P., "A Comparative Study of the Carbon Dioxide Transcritical Power Cycle Compared with an Organic Rankine Cycle with R123 as Working Fluid in Waste Heat Recovery", Science Direct, Applied Thermal Engineering, Jun. 12, 2006, 6 pages.

Chen, Yang, "Thermodynamic Cycles Using Carbon Dioxide as Working Fluid", Doctoral Thesis, School of Industrial Engineering and Management, Stockholm, Oct. 2011, 150 pages., (3 parts).

Chinese Search Report for Application No. 201080035382.1, 2 pages.

Chinese Search Report for Application No. 201080050795.7, 2 pages.

Chordia, Lalit, "Optimizing Equipment for Supercritical Applications", Thar Energy LLC, Supercritical CO2 Power Cycle Symposium, May 24-25, 2011, Boulder, CO, 7 pages.

Colegrove, et al., "Structured Steam Turbines for the Combined-Cycle Market", GE Power Systems, GER-4201, 05/01, 18 pages.

Combs, Osie V., "An Investigation of the Supercritical CO2 Cycle (Feher cycle) for Shipboard Application", Massachusetts Institute of Technology, May 1977, 290 pages.

Di Bella, Francis A., "Gas Turbine Engine Exhaust Waste Heat Recovery Navy Shipboard Module Development", Supercritical CO2 Power Cycle Symposium, May 24-25, 2011, Boulder, CO, 8 pages.

Dostal, V., et al., A Supercritical Carbon Dioxide Cycle for Next Generation Nuclear Reactors, Mar. 10, 2004, 326 pages., (7 parts).

Dostal, Vaclav and Kulhanek, Martin, "Research on the Supercritical Carbon Dioxide Cycles in the Czech Republic", Czech Technical University in Prague, Symposium on SCO2 Power Cycles, Apr. 29-30, 2009, Troy, NY, 8 pages.

Dostal, Vaclav, and Dostal, Jan, "Supercritical CO2 Regeneration Bypass Cycle—Comparison to Traditional Layouts", Supercritical CO2 Power Cycle Symposium, May 24-25, 2011, Boulder, CO, 5 pages.

Ebenezer, Salako A.; "Removal of Carbon Dioxide from Natural Gas for LNG Production", Institute of Petroleum Technology Norwegian University of Science and Technology, Dec. 2005, Trondheim, Norway, 74 pages.

Eisemann, Kevin, and Fuller, Robert L., "Supercritical CO2 Brayton Cycle Design and System Start-up Options", Barber Nichols, Inc., Paper, Supercritical CO2 Power Cycle Symposium, May 24-25, 2011, Boulder, CO, 7 pages.

Eisemann, Kevin, and Fuller, Robert L., "Supercritical CO2 Brayton Cycle Design and System Start-up Options", Presentation, Supercritical CO2 Power Cycle Symposium, May 24-25, 2011, Boulder, CO, 11 pages.

Feher, E.G., et al., "Investigation of Supercritical (Feher) Cycle", Astropower Laboratory, Missile & Space Systems Division, Oct. 1968, 152 pages.

Fuller, Robert L., and Eisemann, Kevin, "Centrifugal Compressor Off- Design Performance for Super-Critical CO2", Barber Nichols, Inc. Presentation, Supercritical CO2 Power Cycle Symposium, May 24-25, 2011, Boulder, CO, 20 pages.

Fuller, Robert L., and Eisemann, Kevin, "Centrifugal Compressor Off-Design Performance for Super-Critical CO2", Paper, Supercritical CO2 Power Cycle Symposium, May 24-25, 2011, Boulder,CO, 12 pages.

Gokhstein, D.P. and Verkhivker, G.P. "Use of Carbon Dioxide as a Heat Carrier and Working Substance in Atomic Power Stations", Soviet Atomic Energy, Apr. 1969, vol. 26, Issue 4, pp. 430-432.

(56) References Cited

OTHER PUBLICATIONS

Gokhstein, D.P.; Taubman, E.I.; Konyaeva, G.P., "Thermodynamic Cycles of Carbon Dioxide Plant with an Additional Turbine After the Regenerator", Energy Citations Database, Mar. 1973, 1 Page, Abstract only.
Gowrishankar, K., "Adaptive Fuzzy Controller to Control Turbine Speed", Rajiv Gandhi College Of Engg. & tech., Puducherry, India, 7 pages.
Hjartarson, Heimir; "Waste Heat Utilization at Elkem Ferrosilicon Plant in Iceland", University of Iceland, 2009, 102 pages.
Hjartarson, et al.; "Waste Heat Utilization from a Submerged ARC Furnace Producing Ferrosilicon", The Twelfth International Ferroalloys Congress Sustainable Future; , Helsinki, Finland ,Jun. 6-9, 2010, 10 pages.
Hejzlar, P. et al., "Assessment of Gas Cooled Gas Reactor with Indirect Supercritical CO2 Cycle" Massachusetts Institute of Technology, Jan. 2006, 10 pages.
Hoffman, John R., and Feher, E.G., "150 kwe Supercritical Closed Cycle System", Transactions of the ASME, Jan. 1971, pp. 70-80.
Jeong, Woo Seok, et al., "Performance of S-CO2 Brayton Cycle with Additive Gases for SFR Application", Korea Advanced Institute of Science and Technology, Supercritical CO2 Power Cycle Symposium, May 24-25, 2011, Boulder, CO, 5 pages.
Johnson, Gregory A., & McDowell, Michael, "Issues Associated with Coupling Supercritical CO2 Power Cycles to Nuclear, Solar and Fossil Fuel Heat Sources", Hamilton Sundstrand, Energy Space & Defense-Rocketdyne, Apr. 29-30, 2009, Troy, NY, Presentation, 18 pages.
Kawakubo, Tomoki, "Unsteady Roto-Stator Interaction of a Radial-Inflow Turbine with Variable Nozzle Vanes", ASME Turbo Expo 2010: Power for Land, Sea, and Air; vol. 7: Turbomachinery, Parts A, B, and C; Glasgow, UK, Jun. 14-18, 2010, Paper No. GT2010-23677, pp. 2075-2084, (1 page, Abstract only).
Kulhanek, Martin, "Thermodynamic Analysis and Comparison of S-CO2 Cycles", Presentation, Czech Technical University in Prague, Supercritical CO2 Power Cycle Symposium, May 24-25, 2011, Boulder,CO, 14 pages.
Kulhanek, Martin, "Thermodynamic Analysis and Comparison of S-CO2 Cycles", Paper, Czech Technical University in Prague, Supercritical CO2 Power Cycle Symposium, May 24-25, 2011, Boulder, CO, 7 pages.
Kulhanek, Martin., and Dostal, Vaclav, "Supercritical Carbon Dioxide Cycles Thermodynamic Analysis and Comparison", Abstract, Faculty Conference held in Prague, Mar. 24, 2009, 13 pages.
Ma, Zhiwen and Turchi, Craig S., "Advanced Supercritical Carbon Dioxide Power Cycle Configurations for Use in Concentrating Solar Power Systems", National Renewable Energy Laboratory, Supercritical CO2 Power Cycle Symposium, May 24-25, 2011, Boulder, CO, 4 pages.
Mohamed, Omar, et al., "Modelling Study of Supercritical Power Plant and Parameter Identified Using Genetic Algorithms", Proceedings of the World Congress on Engineering 2010 vol. II, WCE 2010, Jun. 30-Jul. 2, 2010, London, U.K., 6 pages.
Moisseytsev, Anton, and Sienicki, Jim, "Investigation of Alternative Layouts for the Supercritical Carbon Dioxide Brayton Cycle for a Sodium-Cooled Fast Reactor", Supercritical CO2 Power Cycle Symposium, Troy, NY, Apr. 29, 2009, 26 pages.
Munoz De Escalona, Jose M., "The Potential of the Supercritical Carbon Dioxide Cycle in High Temperature Fuel Cell Hybrid Systems", Paper, Thermal Power Group, University of Seville, Supercritical CO2 Power Cycle Symposium, May 24-25, 2011, Boulder, CO, 6 pages.
Munoz De Escalona, Jose M., et al., "The Potential of the Supercritical Carbon Dioxide Cycle in High Temperature Fuel Cell Hybrid Systems", Presentation, Thermal Power Group, University of Seville, Supercritical CO2 Power Cycle Symposium, May 24-25, 2011, Boulder, CO, 19 pages.
Muto, Y., et al., "Application of Supercritical CO2 Gas Turbine for the Fossil Fired Thermal Plant", Journal of Energy and Power Engineering, Sep. 30, 2010, vol. 4, No. 9, 9 pages.
Muto, Yasushi, and Kato, Yasuyoshi, "Optimal Cycle Scheme of Direct Cycle Supercritical CO2 Gas Turbine for Nuclear Power Generation Systems", International Conference on Power Engineering—2007, Oct. 23-27, 2007, Hangzhou, China, pp. 86-87.
Noriega, Bahamonde J.S., "Design Method for s-CO2 Gas Turbine Power Plants", Master of Science Thesis, Delft University of Technology, Oct. 2012, 122 pages., (3 parts).
Oh, Chang, et al., "Development of a Supercritical Carbon Dioxide Brayton Cycle: Improving PBR Efficiency and Testing Material Compatibility", Presentation, Nuclear Energy Research Initiative Report, Oct. 2004, 38 pages.
Oh, Chang; et al., "Development of a Supercritical Carbon Dioxide Brayton Cycle: Improving VHTR Efficiency and Testing Material Compatibility", Presentation, Nuclear Energy Research Initiative Report, Final Report, Mar. 2006, 97 pages.
Parma, Ed, et al., "Supercritical CO2 Direct Cycle Gas Fast Reactor (SC-GFR) Concept" Presentation for Supercritical CO2 Power Cycle Symposium, May 24-25, 2011, Boulder, CO, 40 pages.
Parma, Ed, et al., "Supercritical CO2 Direct Cycle Gas Fast Reactor (SC-GFR) Concept", Supercritical CO2 Power Cycle Symposium, May 24-25, 2011, Boulder, CO, 9 pages.
Parma, Edward J., et al., "Supercritical CO2 Direct Cycle Gas Fast Reactor (SC-GFR) Concept", Presentation, Sandia National Laboratories, May 2011, 55 pages.
PCT/US2011/029486—International Preliminary Report on Patentability dated Sep. 25, 2012, 6 pages.
PCT/US2011/029486—International Search Report and Written Opinion dated Nov. 16, 2011, 9 pages.
PCT/US2010/049042—International Search Report and Written Opinion dated Nov. 17, 2010, 11 pages.
PCT/US2010/049042—International Preliminary Report on Patentability dated Mar. 29, 2012, 18 pages.
PCT/US2010/031614—International Search Report dated Jul. 12, 2010, 3 pages.
PCT/US2010/031614—International Preliminary Report on Patentability dated Oct. 27, 2011, 9 pages.
PCT/US2010/039559—International Preliminary Report on Patentability dated Jan. 12, 2012, 7 pages.
PCT/US2010/039559—Notification of Transmittal of the International Search Report and Written Opinion of the International Searching Authority, or the Declaration dated Sep. 1, 2010, 6 pages.
PCT/US2010/044681—International Search Report and Written Opinion mailed Oct. 7, 2010, 10 pages.
PCT/US2010/044681—International Preliminary Report on Patentability dated Feb. 16, 2012, 9 pages.
PCT/US2010/044476—International Search Report dated Sep. 29, 2010, 23 pages.
PCT/US2007/001120—International Search Report dated Apr. 25, 2008, 7 pages.
PCT/US2006/049623—Written Opinion of ISA dated Jan. 4, 2008, 4 pages.
PCT/US2007/079318—International Preliminary Report on Patentability dated Jul. 7, 2008, 5 pages.
PCT/US2013/055547—Notification of Transmittal of the International Search Report and the Written Opinion of the International Searching Authority, or the Declaration dated Jan. 24, 2014, 11 pages.
PCT/US2013/064470—Notification of Transmittal of the International Search Report and the Written Opinion of the International Searching Authority, or the Declaration dated Jan. 22, 2014, 10 pages.
PCT/US2013/064471—Notification of Transmittal of the International Search Report and the Written Opinion of the International Searching Authority, or the Declaration dated Jan. 24, 2014, 10 pages.
PCT/US2014/023026—Notification of Transmittal of the International Search Report and the Written Opinion of the International Searching Authority, or the Declaration dated Jul. 22, 2014, 11 pages.
PCT/US2014/013170—Notification of Transmittal of the International Search Report and the Written Opinion of the International Searching Authority, or the Declaration dated May 9, 2014, 12 pages.

(56) References Cited

OTHER PUBLICATIONS

PCT/US2011/062266—International Search Report and Written Opinion dated Jul. 9, 2012, 12 pages.
PCT/US2011/062198—International Search Report and Written Opinion dated Jul. 2, 2012, 9 pages.
PCT/US2011/062198—Extended European Search Report dated May 6, 2014, 9 pages.
PCT/US2011/062201—International Search Report and Written Opinion dated Jun. 26, 2012, 9 pages.
PCT/US2011/062201—Extended European Search Report dated May 28, 2014, 8 pages.
PCT/US2011/062204—International Search Report dated Nov. 1, 2012, 10 pages.
PCT/US2011/62207—International Search Report and Written Opinion dated Jun. 28, 2012, 7 pages.
PCT/US2014/013154—International Search Report dated May 23, 2014, 4 pages.
PCT/US2014/024548—International Search Report and Written Opinion dated Sep. 5, 2014, 11 pages.
PCT/US2013/064475—International Search Report and Written Opinion dated Jan. 16, 2014, 11 pages.
PCT/US2014/024254—International Search Report and Written Opinion dated Aug. 13, 2014, 10 pages.
PCT/US2014/026173—Notification of Transmittal of the International Search Report and the Written Opinion of the International Searching Authority, or the Declaration dated Jul. 9, 2014, 10 pages.
PCT/US2012/000470—International Search Report dated Mar. 8, 2013, 10 pages.
PCT/US2012/061151—International Search Report and Written Opinion dated Feb. 25, 2013, 9 pages.
PCT/US2012/061159—International Search Report dated Mar. 2, 2013, 10 pages.
PCT/US2014/024305—Notification of Transmittal of the International Search Report and the Written Opinion of the International Searching Authority, or the Declaration dated Aug. 26, 2014, 11 pages.
PCT/US2014/023990—Notification of Transmittal of the International Search Report and the Written Opinion of the International Searching Authority, or the Declaration dated Jul. 17, 2014, 10 pages.
PCT/US2015/57701—Notification of Transmittal of the International Search Report and the Written Opinion of the International Searching Authority, or the Declaration dated Dec. 22, 2015, 11 pages.
PCT/US2015/57756—Notification of Transmittal of the International Search Report and the Written Opinion of the International Searching Authority, or the Declaration dated Jul. 27, 2017, 41 pages.
PCT/US2014/020242—Notification of Transmittal of the International Search Report and the Written Opinion of the International Searching Authority, or the Declaration dated Aug. 5, 2014, 9 pages.
PCT/US2018/034289—Notification of Transmittal of the International Search Report and the Written Opinion of the International Searching Authority, or the Declaration dated Oct. 2, 2018, 22 pages.
"Steam Turbines", PDHengineer.com Course No. M-3006.
Steam Turbines (Energy Engineering) http://what-when-how.com/energy-engineering/steam-turbines-energy-engineering/, Oct. 25, 2012, 14 pages.
Persichilli, Michael, et al., "Supercritical CO2 Power Cycle Developments and Commercialization: Why sCO2 can Displace Steam" Echogen Power Systems LLC, Power-Gen India & Central Asia 2012, Apr. 19-21, 2012, New Delhi, India, 15 pages.
Pruess, Karsten, "Enhanced Geothermal Systems (EGS): Comparing Water and CO2 as Heat Transmission Fluids", Proceedings, New Zealand Geothermal Workshop 2007 Auckland, New Zealand, Nov. 19-21, 2007, 13 pages.
Pruess, Karsten, "Enhanced Geothermal Systems (EGS): Using CO2 as Working Fluid—A Novel Approach for Generating Renewable Energy with Simultaneous Sequestration of Carbon", Submitted to Geothermics, Jun. 2006, 26 pages.
Renz, Manfred, "The New Generation Kalina Cycle", Contribution to the Conference: "Electricity Generation from Enhanced Geothermal Systems", Sep. 14, 2006, Strasbourg, France, 18 pages.
Saari, Henry, et al., "Supercritical CO2 Advanced Brayton Cycle Design", Presentation, Carleton University, Supercritical CO2 Power Cycle Symposium, May 24-25, 2011, Boulder, CO, 21 pages.
San Andres, Luis, "Start-Up Response of Fluid Film Lubricated Cryogenic Turbopumps (Preprint)", AIAA/ASME/SAE/ASEE Joint Propulsion Conference, Cincinnati, OH, Jul. 8-11, 2007, 38 pages.
Sarkar, J., and Bhattacharyya, Souvik, "Optimization of Recompression S-CO2 Power Cycle with Reheating" Energy Conversion and Management 50 (May 17, 2009), pp. 1939-1945.
Thorin, Eva, "Power Cycles with Ammonia-Water Mixtures as Working Fluid", Doctoral Thesis, Department of Chemical Engineering and Technology Energy Processes, Royal Institute of Technology, Stockholm, Sweden, 2000, 66 pages.
Tom, Samsun Kwok Sun, "The Feasibility of Using Supercritical Carbon Dioxide as a Coolant for the Candu Reactor", The University of British Columbia, Jan. 1978, 156 pages.
"Two-flow rotors"; http://www.answers.com/topic/steam-turbine#ixzz2AJsKAwHX.
VGB PowerTech Service GmbH, "CO2 Capture and Storage", A VGB Report on the State of the Art, Aug. 25, 2004, 112 pages.
Vidhi, Rachana, et al., "Study of Supercritical Carbon Dioxide Power Cycle for Power Conversion from Low Grade Heat Sources", Presentation, University of South Florida and Oak Ridge National Laboratory, Supercritical CO2 Power Cycle Symposium, May 24-25, 2011, Boulder, CO, 17 pages.
Vidhi, Rachana, et al., "Study of Supercritical Carbon Dioxide Power Cycle for Power Conversion from Low Grade Heat Sources", Paper, University of South Florida and Oak Ridge National Laboratory, Supercritical CO2 Power Cycle Symposium, May 24-25, 2011, Boulder, CO, 8 pages.
Wright, Steven A., et al., "Modeling and Experimental Results for Condensing Supercritical CO2 Power Cycles", Sandia Report, Jan. 2011, 47 pages.
Wright, Steven A., et al., "Supercritical CO2 Power Cycle Development Summary at Sandia National Laboratories", May 24-25, 2011, (1 page, Abstract only).
Wright, Steven, "Mighty Mite", Mechanical Engineering, Jan. 2012, pp. 41-43.
Yoon, Ho Joon, et al., "Preliminary Results of Optimal Pressure Ratio for Supercritical CO2 Brayton Cycle coupled with Small Modular Water Cooled Reactor", Presentation, Korea Advanced Institute of Science and Technology and Khalifa University of Science, Technology and Research, Boulder, CO, May 25, 2011, 18 pages.
Yoon, Ho Joon, et al., "Preliminary Results of Optimal Pressure Ratio for Supercritical CO2 Brayton Cycle coupled with Small Modular Water Cooled Reactor", Paper, Korea Advanced Institute of Science and Technology and Khalifa University of Science, Technology and Research, May 24-25, 2011, Boulder, CO, 7 pages.

* cited by examiner

WASTE HEAT INTEGRATION INTO PUMPED THERMAL ENERGY STORAGE

CROSS-REFERENCE TO RELATED APPLICATION

This application claims priority to U.S. Provisional Application. No. 63/443,775 filed Feb. 7, 2023, the contents of which are incorporated herein by reference for all purposes, including the purpose of priority.

TECHNICAL FIELD

This present disclosure is directed to a Pumped Thermal Energy Storage ("PTES") system and, more particularly, a technique by which round-trip efficiency ("RTE") for a PTES system may be increased.

BACKGROUND

Pumped thermal energy storage ("PTES") systems, also known as electro-thermal energy storage systems, are used to store and generate energy. PTES systems generally consist of a configurable thermodynamic cycle where thermal energy is transferred between a high temperature reservoir and a low temperature reservoir via working fluid in a working fluid circuit. The PTES typically operates in at least two cycles—a charging cycle and a generating cycle. The PTES operates as a heat pump during the charging cycle and as a heat engine during the generating cycle.

During the "charging" cycle of operation, the thermodynamic cycle, which is a heat pump cycle in a nominally forward direction, may be used to increase the thermal energy in a high temperature reservoir. In some instances, an electrical motor may be used to drive a compressor, which increases the pressure and temperature of the working fluid, whereby the thermal energy in the fluid is transferred to and stored in the high temperature reservoir either by using a high temperature heat exchanger or by direct contact between the fluid and the thermal medium of the reservoir. Following the heat transfer to the high temperature reservoir, the fluid may be expanded through a turbine, which produces shaft work that may be used to drive the gas compressor. This working fluid expansion may lower the pressure and temperature of the working fluid. After exiting the turbine, the working fluid may transfer heat from a low temperature reservoir. The working fluid may then be returned to approximately its initial state (e.g., pressure and temperature).

During a "generating" cycle of operation, the directions of fluid and heat circulation are reversed. A pump may increase the pressure of the working fluid and move the working fluid through the high temperature heat exchanger or through the direct contact between the fluid and the thermal medium of the reservoir, which transfers heat from the high temperature reservoir to the working fluid. The heated working fluid may be expanded by a turbine, producing shaft work. The shaft work from the turbine may exceed the compressor work, and the excess work may be converted to electrical power by a generator and distributed to an electrical grid electrically coupled to the generator. Following the turbine expansion, the working fluid may be cooled by passing through the low temperature heat exchanger that is connected to a low temperature reservoir before entering the pump. Upon exit of the low temperature heat exchanger, the working fluid may be returned to approximately its initial state (i.e., pressure and temperature).

SUMMARY

Disclosed herein is a technique by which the round-trip efficiency ("RTE") of a pumped thermal energy storage system may be increased by changing the coefficient of performance ("COP") and efficiency of the cycles by changing the temperature ratios of each, which is accomplished by using two separate low temperature reservoirs ("LTRs") that are at different temperatures. More particularly, the disclosed technique accomplishes this by using a low-temperature thermal reservoir during the charging process that is at a higher temperature than the generating cycle's low-temperature thermal reservoir. The low-temperature thermal reservoirs are "decoupled" and "independently existing", in that their temperature and utilization are independent of one another. In general, decoupled and independently existing reservoirs may also be different in their independent reservoir media, reservoir location, and heat exchangers.

Thus, in a first aspect, a method for use in a Pumped Thermal Energy Storage System ("PTES") comprises: circulating a working fluid through a working fluid circuit; and operating the PTES through a charging cycle and a generating cycle while circulating the working fluid. During the charging cycle, heat is transferred from a first low-temperature thermal reservoir to the working fluid, the first low-temperature thermal reservoir operating at a first temperature. During the generating cycle, heat is transferred from the working fluid to a second low-temperature thermal reservoir, the second low-temperature thermal reservoir existing independently of the first low-temperature reservoir, being decoupled from the first low-temperature thermal reservoir, and operating at a second temperature less than the first temperature.

In a second aspect, a Pumped Thermal Energy Storage System ("PTES"), comprises: a first low-temperature thermal reservoir; a second low temperature thermal reservoir; and a working fluid circuit through which a working fluid is circulated in operation. The working fluid circuit includes, during a charging cycle, a first low-temperature heat exchanger that, in operation, transfers heat from the first low-temperature thermal reservoir to the working fluid, the first low-temperature thermal reservoir operating at a first temperature. During a generating cycle, the working fluid circuit includes a second low-temperature heat exchanger that, in operation, transfers heat from the working fluid to a second low-temperature thermal reservoir. The second low-temperature thermal reservoir exists independently of the first low-temperature reservoir, is decoupled from the first low-temperature thermal reservoir, and operates at a second temperature less than the first temperature.

The above presents a simplified summary in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

BRIEF DESCRIPTION OF THE DRAWINGS

The present disclosure is best understood from the following detailed description when read with the accompanying Figures. It is emphasized that, in accordance with the standard practice in the industry, various features are not drawn to scale or are shown in simplified form. In fact, the dimensions of the various features may be arbitrarily increased or reduced for clarity of discussion.

Figure 1A:
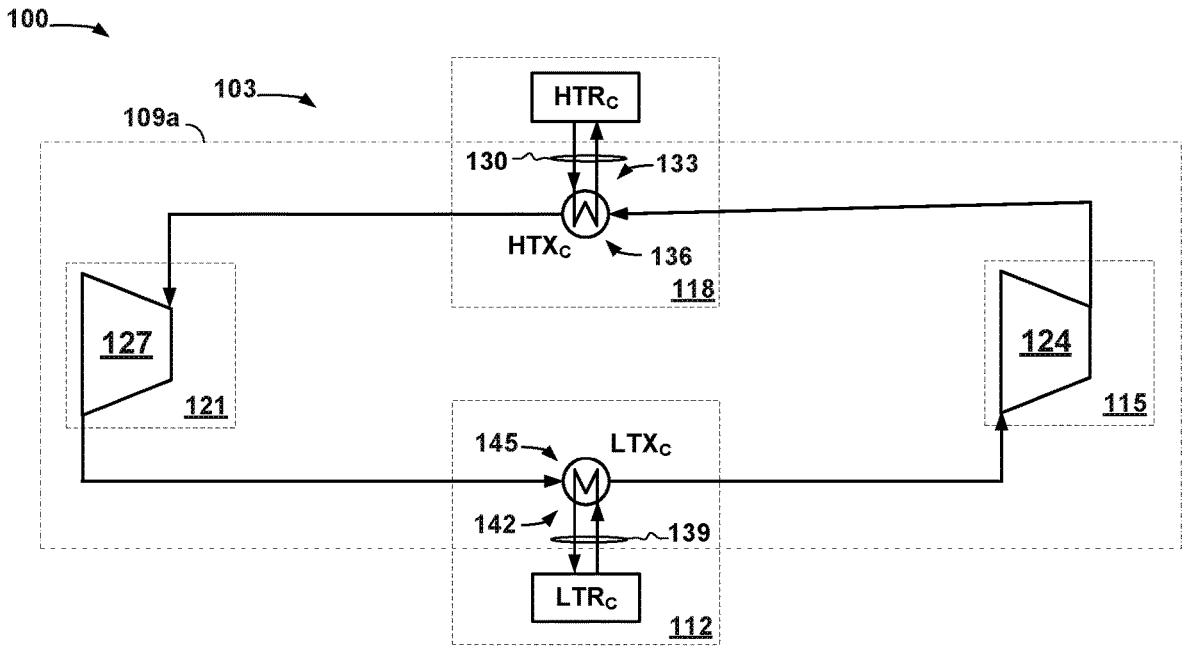
FIG. 1A and FIG. 1B illustrate a PTES system during a charging cycle and during a generating cycle, respectively in accordance with one or more embodiments.

While the disclosed technique is susceptible to various modifications and alternative forms, the drawings illustrate specific embodiments herein described in detail by way of example. It should be understood, however, that the description herein of specific embodiments is not intended to limit that which is claimed to the particular forms disclosed, but on the contrary, the intention is to cover all modifications, equivalents, and alternatives falling within the spirit and scope of the appended claims.

DETAILED DESCRIPTION

Illustrative examples of the subject matter claimed below will now be disclosed. In the interest of clarity, not all features of an actual implementation are described in this specification. It will be appreciated that in the development of any such actual implementation, numerous implementation-specific decisions may be made to achieve the developers' specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

Thus, in a charging cycle, heat is added to the working fluid from the low-temperature reservoir ("LTR") and removed from the working fluid to the high-temperature reservoir ("HTR"). And, in a generating cycle, heat is added to the working fluid from the high-temperature reservoir and removed from the working fluid to the low-temperature reservoir. A PTES system typically uses a low-temperature thermal resource to supply heat to the heat pump in the charging cycle. Typically, the same thermal resource is used to reject heat by the heat engine in the generating cycle. The thermal resource may be stored in an engineered reservoir (such as a contained reservoir like a fluid tank) or in a natural reservoir (such as ambient air).

A figure of merit for a heat pump is coefficient of performance ("COP"), defined as the ratio of energy product (high-temperature heat, $Q_h$) to energy cost (net work, W). The figure of merit for a heat engine is thermal efficiency ($\eta$), defined as the ratio of energy product (net work, W) to energy cost (high-temperature heat, $Q_h$). The combined figure of merit for a PTES system is round-trip efficiency ("RTE"), defined as the product of COP and n.

Based on Carnot principles, COP increases as the temperature ratio between the high-temperature reservoir and low-temperature reservoir ($T_h/T_c$) decreases. Conversely, $\eta$ increases as $T_h/T_c$ increases. In a PTES system, the heat pump and the heat engine typically share common reservoirs. Thus, decreasing Thor increasing $T_c$ is expected to increase COP while decreasing $\eta$. Similarly, increasing $T_h$ or decreasing $T_c$ is expected to decrease COP while increasing $\eta$. In general, reservoir temperature changes that benefit one cycle's performance are a detriment to the other cycle's performance, muting the overall impact to RTE.

A simplified numerical model of a PTES system, in which the charging and generating processes are represented by imperfect Carnot heat pump and Carnot heat engines can be considered:

$$COP_{hp} = C_{hp}\frac{1}{1-\left(\frac{T_{c,chg}}{T_h}\right)}$$

$$\eta_{gen} = C_{gen}\left[1-\left(\frac{T_{c,gen}}{T_h}\right)\right]$$

Where the "C" factors represent the actual performance of the cycles relative to the Carnot ideal. The RTE can be represented by the mathematical product of the two terms above:

$$RTE = C_{hp}C_{gen}\left[\frac{1-\left(\frac{T_{c,gen}}{T_h}\right)}{1-\left(\frac{T_{c,chg}}{T_h}\right)}\right]$$

Since $T_{c,chg}>T_{c,gen}$, we can represent $T_{c,chg}=T_{c,gen}+\Delta T$. Substituting in the above, and assuming $\Delta T \ll T_h - T_{c,gen}$, we can find $$RTE = C_{hp}C_{gen}\left(1+\frac{\Delta T}{T_h - T_{c,gen}}\right)$$

For the baseline case, where $\Delta T=0$, $RTE_{bl}=C_{hp}C_{gen}$, so $$\frac{RTE}{RTE_{bl}} = 1+\frac{\Delta T}{T_h - T_{c,gen}}$$

For example, in the case where $T_h - T_{c,gen}=300$ K, and the charging heat source was 15 K warmer than the generating heat source, the projected improvement in RTE would be 5%, or an increase from a baseline RTE of 60% to 63%.

An example of this situation would be a PTES system that is co-located with an existing closed-cycle power generating station. Most closed-cycle power plants, such as nuclear, coal-fired, concentrating solar or combined cycle gas turbine plants, use steam as the working fluid to convert high-temperature thermal energy to mechanical and electrical power using a turbine. To close the steam cycle, low-pressure steam at the turbine discharge must be condensed back to a liquid state.

The heat that is recovered from this process is typically at temperatures that are low compared to the steam turbine inlet temperature, but at temperatures that are higher than the ambient air temperature by at least 15° C. or more to enable transfer of that residual heat to the ambient environment. In the disclosed concept, the PTES system would use this residual heat as the heat source during the charging process. At a later time, the PTES system would generate power, and reject heat to the ambient environment, thus achieving a higher RTE than could be achieved by a standalone PTES system that was charged from an ambient resource.

The power generating station could be one source of waste heat, with possible source locations including generating turbine condensate or cooling tower water. Additionally, many industrial plants (such as refineries, pulp and paper mills, and cement plants) have numerous sources of waste heat. Broadly speaking, if a waste heat source is warmer than ambient air, it can be used by a PTES system to boost COP without detriment to $\eta$, for a net increase to RTE.

For power generating stations using steam cycles in cold climates, the impact would be even higher than the previous example. If the heat source temperature is from a steam condenser, the temperature is fixed to avoid ice accumulation in the cooling towers, and the lower ambient temperature would increase $\Delta T$ further. As an added benefit, the extraction from the heat source would also reduce the parasitic cooling loads (e.g., cooling tower fan work) of the steam cycle.

Figure 1B:
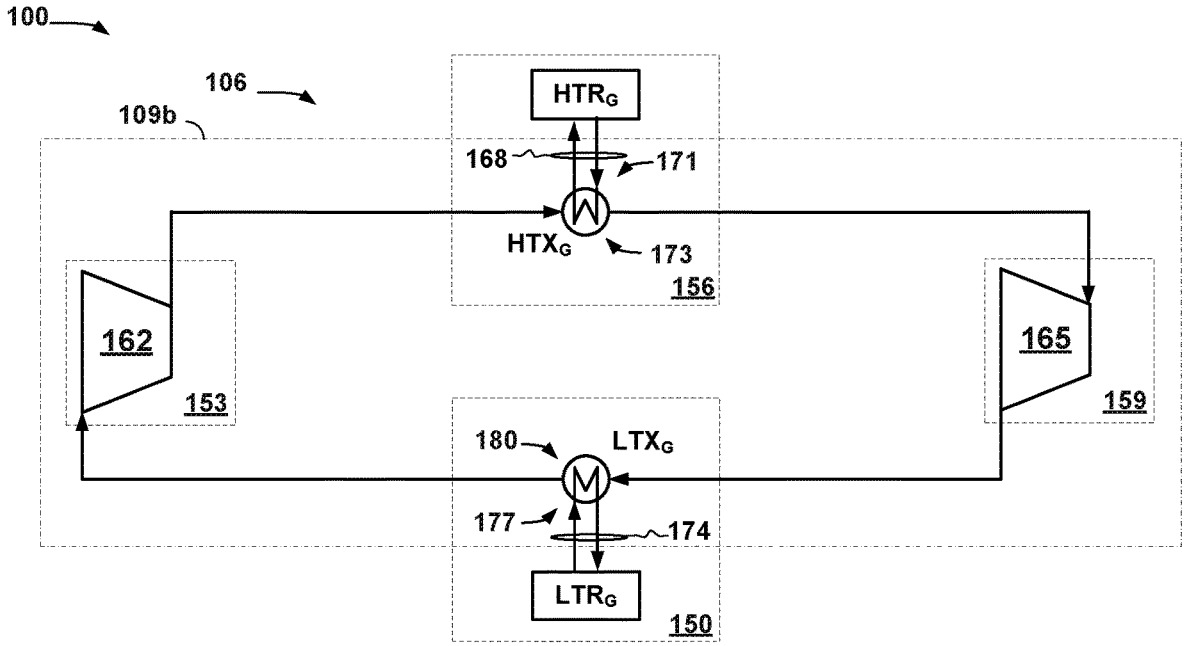

Turning now to the drawings, FIG. 1A and FIG. 1B illustrate a PTES system 100 during a charging cycle 103 and during a generating cycle 106, respectively. Those in the art will appreciate that, although shown in two different drawings, the charging cycle 103 in FIG. 1A and the generating cycle 106 in FIG. 1B are two different configurations of a single PTES system 100 not otherwise shown. The configuration includes controlling the working fluid flow through a working fluid circuit by operation of flow control valves in a manner more fully disclosed below.

Those in the art will also appreciate that there are some details omitted from FIG. 1A and FIG. 1B. For example, any particular implementation will include a variety of sensors to measure, for instance, temperatures, pressures, and flow rates at various points in the working fluid circuit. Omitted features may also include things such as fill ports, drains, relief valves, and power supply connections. These kinds of omitted features are ubiquitous and well known in the art and may be routinely implemented. Thus, those skilled in the art having the benefit of this disclosure will both be able to recognize their applicability and readily implement these omitted details. Accordingly, these kinds of details are omitted for the sake of clarity and so as not to obscure that which is claimed below.

Returning now to FIG. 1A, in the charging cycle 103, the working fluid circuit 109*a* includes a low-temperature heat exchange 112, a compression process 115, a high-temperature heat exchange 118, and an expansion process 121. The PTES 100, when in this configuration, may be referred to as a "heat pump". This configuration of the working fluid circuit 109 may be referred to as the "charging configuration" or the "heat pump configuration" of the PTES 100. The working fluid in the embodiments illustrated herein is Carbon dioxide ($CO_2$), but alternative embodiments may use alternative working fluids.

The compression process 115 is downstream from the low temperature heat exchange 112 and upstream from the high-temperature heat exchange 118. The compression process 115, among other things, provides the motive force for circulating the working fluid through the working fluid circuit 109*a* during the charging cycle 103. The compression process 115 revolves around the operation of a compression device 124. The compression device 124 may be a compressor. Examples of suitable compressors include, without limitation, reciprocating compressors, centrifugal compressors, and scroll compressors. Those skilled in the art having the benefit of this disclosure may appreciate other kinds of compressors that may be suitable in various embodiments, including means of equivalent structure performing the disclosed function. The compression process 115 receives the working fluid from the low-temperature exchange 112, compresses the working fluid to increase the temperature and pressure thereof, and discharges the working fluid to the high-temperature heat exchange 118.

The expansion process 121 is downstream from the high-temperature heat exchange 118 and upstream from the low temperature heat exchange 112. The expansion process 121 revolves around the operation of an expansion device 127, such as an expander. Examples of suitable expanders include, without limitation, an adiabatic expansion valve or a mechanical expander depending on the embodiment. A mechanical expander may be, for instance, a turbine. Those skilled in the art having the benefit of this disclosure may appreciate other kinds of expanders that may be suitable in various embodiments, including means of equivalent structure performing the disclosed function. The expansion process 121 receives the working fluid from the high-temperature exchange 118, expands the working fluid to reduce the temperature and pressure thereof, and discharges the working fluid to the low-temperature exchange 112.

The high-temperature heat exchange 118 exchanges heat between the working fluid and a high-temperature thermal reservoir $HTR_C$. A first exchange medium (not separately shown) circulates between the high-temperature thermal reservoir $HTR_C$ and the high-temperature heat exchanger $HTX_C$. The first exchange medium circulates through the lines 130 on a first side 133 of the high-temperature heat exchanger $HTX_C$. The working fluid enters the high-temperature heat exchanger $HTX_C$ from the compression process 115 and exits to the expansion process 121 on a second side 136 of the high-temperature heat exchanger $HTX_C$. In the high-temperature heat exchanger $HTX_C$, heat is exchanged from the working fluid to the first exchange medium for storage in the high-temperature thermal reservoir $HTR_C$.

Figure 2A:
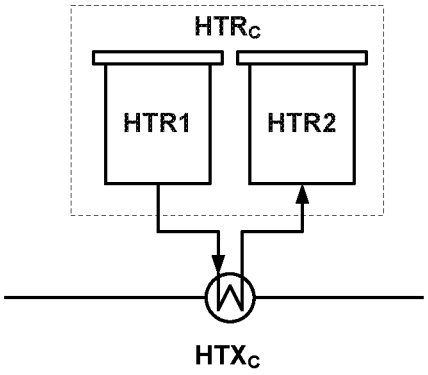
FIG. 2A and FIG. 2B illustrate respectively, a high-temperature heat exchange including a high-temperature thermal reservoir comprised of two fluid tanks and a low-temperature heat exchange including a low-temperature thermal reservoir comprised of two fluid tanks, as may be used in some embodiments.

The high-temperature thermal reservoir $HTR_C$ may be an engineered, contained reservoir, like a fluid tank. The contained reservoir may include a thermal medium such as sand or gravel, concrete, encapsulated phase-change materials, bulk phase-change materials, or a combination thereof. Note that in some embodiments, the high-temperature thermal reservoir $HTR_C$ may include two fluid tanks HTR1 and HTR2 as shown in FIG. 2A.

The low-temperature heat exchange 112 exchanges heat between the working fluid and a low-temperature thermal reservoir $LTR_C$. A second exchange medium (not separately shown) circulates between the low-temperature reservoir $LTR_C$ and the low-temperature heat exchanger $LTX_C$. The second exchange medium circulates through the lines 139 on one side 142 of the low-temperature heat exchanger $LTX_C$. The working fluid enters the low-temperature heat exchanger $LTX_C$ from the expansion process 121 and exits to the compression process 115 on a second side 145 thereof. In the low-temperature heat exchanger $LTX_C$, heat from the low-temperature thermal reservoir $LTR_C$ is exchanged from the second exchange medium to the working fluid.

Figure 2B:
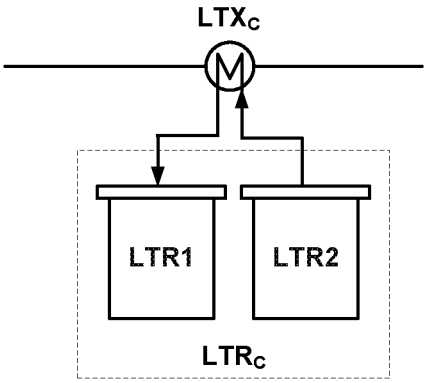

The low-temperature thermal reservoir $LTR_C$ may be an engineered reservoir or a natural reservoir. If engineered, the low-temperature thermal reservoir $LTR_C$ may be a contained reservoir, like a fluid tank. The contained reservoir may include a thermal medium such as sand or gravel, concrete, encapsulated phase-change materials, bulk phase-change materials, or a combination thereof. If a natural reservoir, the low-temperature thermal reservoir $LTR_C$ may be, for example, ambient atmosphere or a geothermal reservoir. Note that in some embodiments, the low-temperature thermal reservoir $LTR_C$ may include two fluid tanks LTR1 and LTR2 as shown in FIG. 2B.

In the illustrated embodiment, the low-temperature thermal reservoir $LTR_C$ may alternatively be a waste heat source—that is, a heat generated by another process. A waste heat source may comprise waste heat, low-value heat, or low-grade heat, or heat from other processes that are low impact to the original process but are not completely waste heat. For example, a power generating station may be a source of waste heat in its turbine discharge flow. Possible source locations in a power generating station may include generating turbine condensate or cooling tower water. Additionally, many industrial plants (such as refineries, pulp and paper mills, and cement plants) have numerous sources of waste heat. This waste heat may be captured from a medium that may be used for the low-temperature thermal reservoir $LTR_C$ in the illustrated embodiment.

In the illustrated embodiment, the low-temperature thermal reservoir $LTR_C$ may be an ambient atmosphere. As noted above, broadly speaking, if a waste heat source is warmer than ambient air, it can be used by a PTES system to boost COP without detriment to $\eta$, for a net increase to RTE. Thus, in the illustrated embodiment, the ambient atmosphere is cooler (and has less thermal energy) than the waste heat source. In some embodiments, the ambient atmosphere may be 5° C. or more cooler than the waste heat source.

Referring again to FIG. 1A, during the "charging" cycle of operation, the thermal energy in the high temperature reservoir is increased. The compression process 115 increases the pressure and temperature of the working fluid. The high-temperature heat exchange 118 transfers thermal energy to the high temperature reservoir $HTR_C$ and is stored. Following the heat transfer to the high temperature reservoir $HTR_C$, the working fluid is expanded through the expansion process 121, which lowers the pressure and temperature of the working fluid. After exiting the expansion process 121, the working fluid passes through a low-temperature heat exchange 112. The low-temperature heat exchange 112 transfers heat from the low temperature reservoir $LTR_C$ to the working fluid. Upon exiting the low-temperature heat exchange 112, the working fluid is returned to approximately its initial state (e.g., pressure and temperature).

Referring now to FIG. 1B, in the generating cycle 106, the working fluid circuit 109*b* includes a low-temperature heat exchange 150, a compression process 153, a high-temperature heat exchange 156, and an expansion process 159. The PTES 100 operates as a heat engine in this configuration. This configuration of the working fluid circuit 109*b* may be referred to as the "generating configuration", "discharging configuration", or "heat engine configuration" of the PTES 100. The working fluid in the embodiments illustrated herein is still Carbon dioxide ($CO_2$), but alternative embodiments may use alternative working fluids.

The compression process 153 is downstream from the low-temperature heat exchange 150 and upstream from the high-temperature exchange 156. The compression process 153, among other things, provides the motive force for circulating the working fluid through the working fluid circuit 109*b* during the generating cycle 106. The compression process 153 revolves around the operation of a compression device 162.

The compression device 162 may be a pump or gas-phase compressor. Examples of suitable compression devices include, without limitation, centrifugal pumps, positive displacement pumps, centrifugal compressors and axial compressors. Those skilled in the art having the benefit of this disclosure may appreciate other kinds of compression devices that may be suitable in various embodiments, including means of equivalent structure performing the disclosed function. The compression process 153 receives the working fluid from the low-temperature exchange 150, compresses the working fluid to increase the temperature and pressure thereof, and discharges the working fluid to the high-temperature heat exchange 156.

The expansion process 159 is downstream from the high-temperature heat exchange 156 and upstream from the low temperature heat exchange 150. The expansion process 159 revolves around the operation of an expansion device 165, such as an expander. Examples of suitable expanders include, without limitation, a mechanical expander depending on the embodiment. A mechanical expander may be, for instance, a turbine. Those skilled in the art having the benefit of this disclosure may appreciate other kinds of expanders that may be suitable in various embodiments, including means of equivalent structure performing the disclosed function. The expansion process 159 receives the working fluid from the high-temperature exchange 156, expands the working fluid to reduce the temperature and pressure thereof, and discharges the working fluid to the low-temperature exchange 150.

The high-temperature heat exchange 156 exchanges heat between the working fluid and a high-temperature thermal reservoir $HTR_G$. A first exchange medium (not separately shown) circulates between the high-temperature thermal reservoir $HTR_G$ and the high-temperature heat exchanger $HTX_G$. The first exchange medium circulates through the lines 168 on a first side 171 of the high-temperature heat exchanger $HTX_G$. The working fluid enters the high-temperature heat exchanger $HTX_G$ from the compression process 153 and exits to the expansion process 159 on a second side 173 of the high-temperature heat exchanger $HTX_G$. In the high-temperature heat exchanger $HTX_G$, heat is exchanged from the high-temperature thermal reservoir $HTR_G$ via the first exchange medium to the working fluid.

The high-temperature thermal reservoir $HTR_G$ may be an engineered, contained reservoir, like a fluid tank. The contained reservoir may include a thermal medium such as sand or gravel, concrete, encapsulated phase-change materials, bulk phase-change materials, or a combination thereof. Note that in some embodiments, the high-temperature thermal reservoir $HTR_G$ may include two fluid tanks HTR1 and HTR2 just as the high-temperature thermal reservoir $HTR_C$ for the charging cycle is shown in FIG. 2A.

The low-temperature heat exchange 150 exchanges heat between the working fluid and a low-temperature thermal reservoir $LTR_G$. A second exchange medium (not separately shown) circulates between the low-temperature reservoir $LTR_G$ and the low-temperature heat exchanger $LTX_G$. The second exchange medium circulates through the lines 174 on one side 177 of the low-temperature heat exchanger $LTX_G$. The working fluid enters the low-temperature heat exchanger $LTX_G$ from the expansion process 159 and exits to the compression process 153 on a second side 180 thereof. In the low-temperature heat exchanger $LTX_G$, heat from the working fluid is exchanged from the second exchange medium to the low-temperature thermal reservoir $LTR_G$.

The low-temperature thermal reservoir $LTR_G$ may be an engineered reservoir or a natural reservoir. If engineered, the low-temperature thermal reservoir $LTR_G$ may be a contained reservoir, like a fluid tank or may be a fluid stream of some kind. The contained reservoir may include a thermal medium such as sand or gravel, concrete, encapsulated phase-change materials, bulk phase-change materials, or a combination thereof. If a natural reservoir, the low-temperature thermal reservoir $LTR_G$ may be, for example, ambient atmosphere or a geothermal reservoir. Note that in some embodiments, the low-temperature thermal reservoir $LTR_G$ may include two fluid tanks LTR1 and LTR2 as shown in FIG. 2B for the low-temperature reservoir $LTR_C$ in the charging cycle.

In the illustrated embodiment, the low-temperature thermal reservoir $LTR_G$ may be an ambient atmosphere or a geothermal reservoir. As noted above, broadly speaking, if a waste heat source is warmer than ambient air, it can be used by a PTES system to boost COP without detriment to $\eta$, for a net increase to RTE. Thus, in the illustrated embodiment, the ambient atmosphere is cooler than is the waste heat source. In some embodiments, the ambient atmosphere may be 5° C. or more cooler than the waste heat source.

During the "generating" cycle of operation, the directions of fluid and heat circulation are reversed relative to the charging cycle discussed above. The compression process 153 increases the pressure of the working fluid and moves the working fluid through the high temperature heat exchange 156, which transfers heat from the high temperature reservoir to the working fluid. The heated working fluid may be expanded by the expansion process 159 by, for example, a turbine producing shaft work. The shaft work from the turbine may exceed the compressor work, and the excess work may be converted to electrical power by a generator and distributed to an electrical grid electrically coupled to the generator. Following the expansion process 159, the working fluid may be cooled by passing through the low temperature heat exchange 150 that is connected to a low temperature reservoir $LTR_G$ before entering the compression process 153 (e.g., a pump). Upon exit from the low temperature heat exchange 150, the working fluid may be returned to approximately its initial state (i.e., pressure and temperature).

In accordance with the subject matter claimed below, the low-temperature thermal reservoirs $LTR_C$ and $LTR_G$ are "decoupled", "independently existing", and operate at different temperatures. The low-temperature thermal reservoirs $LTR_C$ and $LTR_G$ are "decoupled" and "independently existing" in that their temperature and utilization are independent of one another. In general, decoupled and independently existing reservoirs may also be different in their independent reservoir media, reservoir location, and heat exchangers. More particularly, the second temperature at which the low-temperature thermal reservoir $LTR_G$ operates in the generating cycle is less than the first temperature at which the low-temperature thermal reservoir $LTR_C$ operates in the charging cycle by an amount exceeding at least about 5° C. In some embodiments, the second temperature is about 15° C. less than the first temperature. Some embodiments may manifest even greater temperature differentials.

Thus, referring to both FIG. 1A and FIG. 1B, collectively, the PTES 100 comprises a first low-temperature thermal reservoir $LTR_C$; a second low temperature thermal reservoir $LTR_C$; and a working fluid circuit 109*a*, 109*b* through which a working fluid is circulated in operation. The working fluid circuit 109*a* includes, during a charging cycle 103, a first low-temperature heat exchanger $LTX_C$ that, in operation, transfers heat from the first low-temperature thermal reservoir $LTR_C$ to the working fluid, the first low-temperature thermal reservoir $LTR_C$ operating at a first temperature. During a generating cycle, the working fluid circuit 109*b* includes a second low-temperature heat exchanger $LTX_G$ that, in operation, transfers heat from the working fluid to a second low-temperature thermal reservoir $LTR_G$. The second low-temperature thermal reservoir $LTR_G$ is decoupled from the first low-temperature thermal reservoir $LTR_C$ and operates at a second temperature less than the first temperature.

Furthermore, a method for use in a PTES 100 comprises: circulating a working fluid through a working fluid circuit 109*a*, 109*b* and operating the PTES 100 through a charging cycle 103 and a generating cycle 106 while circulating the working fluid. During the charging cycle 103, heat is transferred from a first low-temperature thermal reservoir $LTR_C$ to the working fluid, the first low-temperature thermal reservoir $LTR_C$ operating at a first temperature. During the generating cycle, heat is transferred from the working fluid to a second low-temperature thermal reservoir $LTR_G$, the second low-temperature thermal reservoir $LTR_G$ being decoupled from the first low-temperature thermal reservoir $LTR_C$ and operating at a second temperature less than the first temperature.

Those in the art having the benefit of this disclosure will appreciate additional embodiments not illustrated in the drawings hereof. For instance, the embodiments illustrated herein perform the heat exchanges using a heat exchangers. However, as mentioned above, some embodiments may omit the heat exchanger and perform the heat exchange by direct contact between the thermal medium of the thermal reservoir and the working fluid. This change, in turn, would eliminate the exchange media of the illustrated embodiments since the heat exchange is direct rather than indirect. This may be true of one or both of the high-temperature heat exchange and the low temperature exchange depending on the embodiment. This may also be true in one or both of the charging cycle and the generating cycle.

Figure 3A:
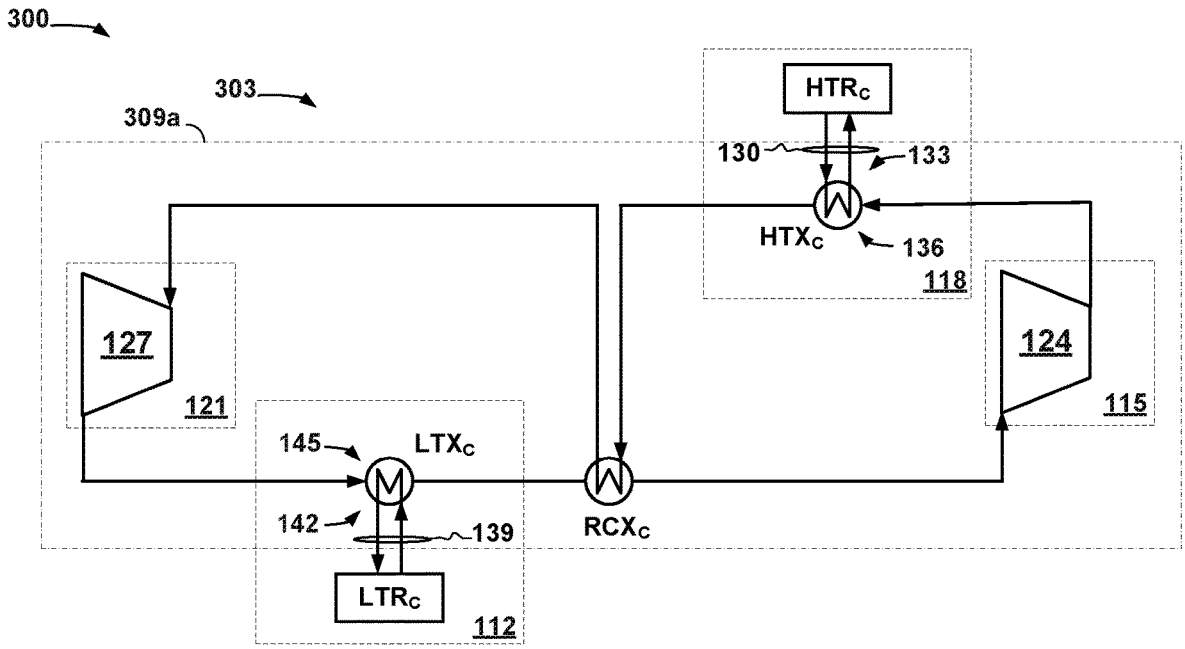
FIG. 3A and FIG. 3B illustrate a recuperated PTES system during a charging cycle and during a generating cycle, respectively in accordance with one or more embodiments.
Figure 3B:
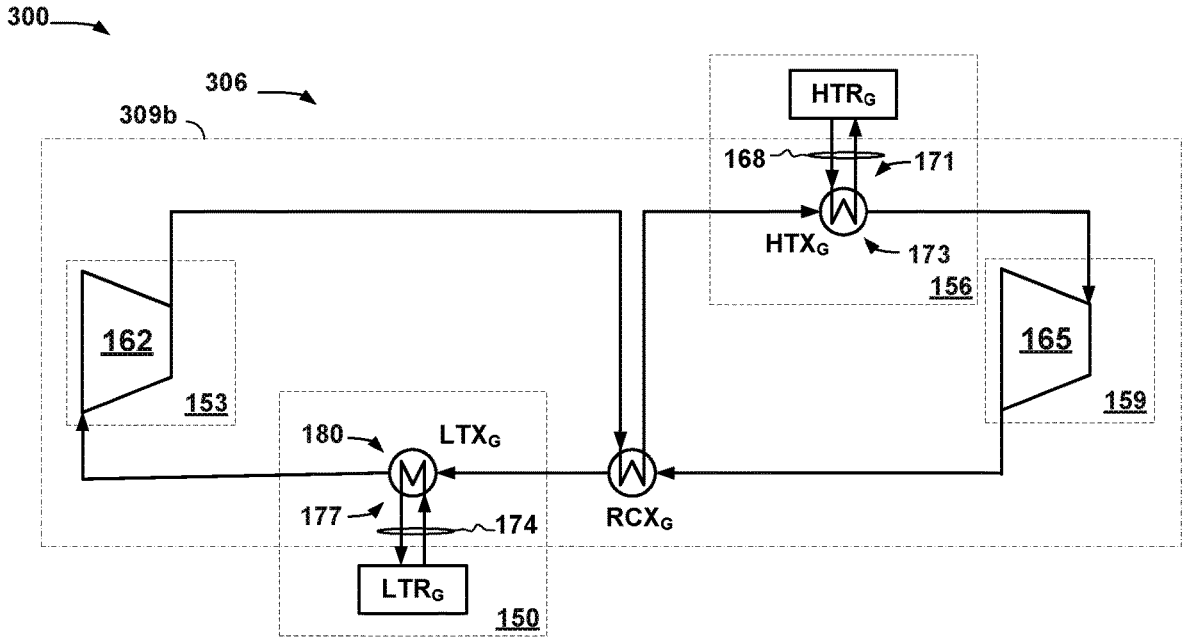

For another example, the PTES 100 of FIG. 1A-FIG. 1B is not a recuperated PTES—i.e., there is no recuperator in that design. A recuperated PTES 300 is shown in FIG. 3A and FIG. 3B in a charging cycle 303 and a generating cycle 306 respectively. A recuperated PTES adds to the working fluid circuits 309*a*, 309*b* an internal heat exchanger to transfer heat after (in working fluid circuit 309*a*) or before (in working fluid circuit 309*b*) the high-temperature heat exchanger ("HTX") to preheat (in working fluid circuit 309*a*) or precool (in working fluid circuit 309*b*) the fluid exiting (in working fluid circuit 309*a*) or entering (in working fluid circuit 309*b*) the low-temperature heat exchanger ("LTX").

This internal heat exchanger is the "recuperator" ("RCX"). By preheating the fluid medium, a higher post-compressor temperature can be attained at a reasonable pressure ratio. The recuperated PTES 300 includes a recuperator $RCX_C$ in the charging cycle 303 and a recuperator $RCX_G$ in the generating cycle 306. Note that, in most embodiments, the recuperator $RCX_C$ in the charging cycle 303 and the recuperator $RCX_G$ in the generating cycle 306 may be implemented using the same physical device. Note that the PTES 300 of FIG. 3A-FIG. 3B includes many like parts relative to the PTES 100 in FIG. 1A-FIG. 1B and that like parts bear like designations.

Figure 4:
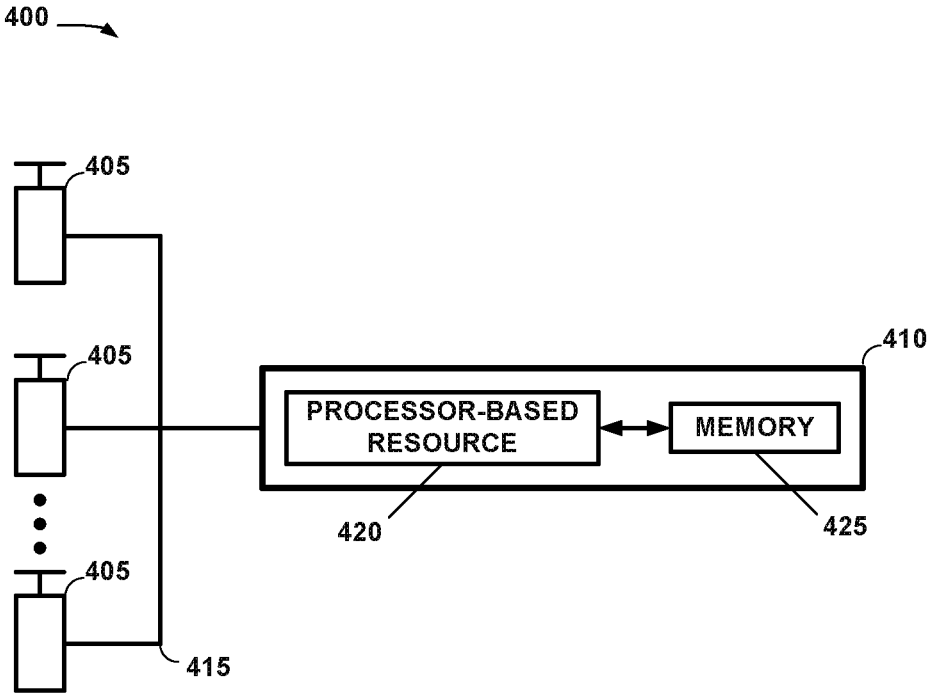
FIG. 4 is a flow control system as may be used in configuring the PTES system of FIG. 1A-FIG. 1B and/or FIG. 3A-FIG. 3B according to one or more examples of the disclosure.

As was mentioned above, the configuration of the working fluid circuit 109*a*, 109*b* between the charging cycle shown in FIG. 1A and the generating cycle shown in FIG. 1B may be controlled by fluid flow valves. Although such control systems are readily known to those in the art, one such control system 400 is shown in FIG. 4 for the sake of completeness. The control system 400 may include a plurality of fluid flow valves 405 and a controller 410 sending control signals over electrical lines 415.

The controller 410 includes a processor-based resource 420 that may be, for example and without limitation, a microcontroller, a microprocessor, an Application Specific Integrated Circuit ("ASIC"), an Electrically Erasable Programmable Read-Only Memory ("EEPROM"), or the like. Depending on the implementation of the processor-based resource, the controller 410 may also include a memory 425 encoded with instructions (not shown) executable by the processor-based resource 420 to implement the functionality of the controller 410. Again, depending on the implementation of the processor-based resource 420, the memory 425 may be a part of the processor-based resource 420 or a stand-alone device. For example, the instructions may be firmware stored in the memory portion of a microprocessor or they may be a routine stored in a stand-alone read-only or random-access memory chip. Similarly, in some implementations of the processor-based resource 420—e.g., an ASIC—the memory 435 may be omitted altogether.

Referring now collectively to FIG. 1A-FIG. 1B and FIG. 4, a controller such as the controller 410 may be used to configure the working fluid circuit 109*a*, 109*b* between the charging cycle as shown in FIG. 1A and generating cycle shown in FIG. 1B. The controller 410 may send control signals to the fluid flow valves 405 to control the working fluid flow. Thus, to configure the working fluid circuit 109*a* for the charging cycle 103, the controller 410 controls the fluid flow valves 405 to direct the working fluid to the compression process 115 and the expansion process 121 while diverting the working fluid away from the expansion process 159 and the compression process 153. Conversely, to configure the working fluid circuit 109*b* for the generating cycle 106, the controller 410 controls the fluid flow valves 405 to direct working fluid to the expansion process 159 and the compression process 153 while diverting the working fluid away from the compression process 115 and the expansion process 127.

Note that, in accordance with usage in the art, the terms "high-temperature" and "low-temperature" in the "high-temperature heat exchange" and the "low-temperature heat exchange" are defined relative to one another. That is, the terms indicate that the heat exchange in the "high-temperature heat exchange" occurs at a temperature higher than the temperature at which the heat exchange in the "low-temperature heat exchange" occurs. Some embodiments may perform a high-temperature heat exchange at 350° C. and a low-temperature heat exchange at 20° C. with differentials (a/k/a approach temperatures) of approximately 5° C. However, the quantification of the temperatures at which these heat exchanges occur will be an implementation specific detail for any given embodiment, as will be the temperature differential of the temperature at which these exchanges occur. In the phrases pertaining to equipment, such as "low-temperature heat exchanger", "low-temperature reservoir", "high-temperature heat exchanger", and "high-temperature reservoir", the terms indicate the particular heat exchange in which the equipment is used.

Furthermore, the terms "low-temperature heat exchange" and "high-temperature heat exchange", on their face, imply a single temperature. Those in the art having the benefit of this disclosure will appreciate that there may be different temperatures at various points of the heat exchange. For example, the temperature at the inlet to the heat exchange may be one temperature, the temperature of the medium may be a second temperature, and the temperature at the outlet may be a third temperature. In accordance with the practice in the art, however, the heat exchange may be represented or conceptualized as a single temperature for practical purposes in operation and discussion. The present disclosure, when referencing such a single temperature, generally references the temperature from the storage reservoir entering the respective heat exchanger.

Terms of equivocation such as "about", "approximately", etc. relative to any quantity in this disclosure indicates that some deviation from the stated quantity may be tolerated so long as the actual quantity is within some margin for error in which the operation of the overall system achieves some desired level of efficiency. For example, as discussed above, the difference in the temperature at which the low-temperature heat exchange occurs during the generating cycle may be at least about 5° C. less than the temperature at which the low-temperature heat exchange occurs during the charging cycle. However, a difference of +0.1° C. or greater may be experienced because of operational conditions such that the difference may be only 4.9° C. or less. Such a deviation may be tolerated so long as the operation of the overall system achieves some desired level of efficiency. The same is true of any other quantity discussed or disclosed herein. Accordingly, in accordance with the technique disclosed herein, the first low-temperature reservoir (i.e., the low-temperature reservoir of the charging cycle) is, relative to the second low-temperature reservoir (i.e., the low-temperature reservoir of the generating cycle): independently existing, decoupled, and operating at a higher temperature. Either or both of the first and second low-temperature reservoirs may be either an engineered source or a natural reservoir. An engineered source may be, for instance, a contained reservoir or a waste (e.g., low-grade or low value) heat source from another process. A natural reservoir may be, for example, an ambient atmosphere or a geothermal source.

Thus, in a first embodiment, a method for use in a Pumped Thermal Energy Storage System ("PTES"), the method comprises circulating a working fluid through a working fluid circuit; and operating the PTES through a charging cycle and a generating cycle while circulating the working fluid. During the charging cycle, heat is transferred from a first low-temperature thermal reservoir to the working fluid, the first low-temperature thermal reservoir operating at a first temperature. During the generating cycle, heat is transferred from the working fluid to a second low-temperature thermal reservoir. The second low-temperature thermal reservoir exists independently of the first low-temperature thermal reservoir, is decoupled from the first low-temperature thermal reservoir, and operates at a second temperature less than the first temperature.

In a second embodiment, the second temperature in the first embodiment is less than the first temperature by an amount exceeding about 5° C.

In a third embodiment, the second temperature in the second embodiment is about 15° C. less than the first temperature.

In a fourth embodiment, the working fluid in the first embodiment is Carbon dioxide (CO2).

In a fifth embodiment, the first low-temperature reservoir of the first embodiment is a waste heat source while the second low-temperature reservoir is an ambient atmosphere.

In a sixth embodiment, the first embodiment further comprises configuring the working fluid circuit for the charging cycle and for the generating cycle.

In a seventh embodiment, the charging cycle of the first embodiment further comprises: exchanging heat between the working fluid and a first high-temperature thermal reservoir; a compression process downstream from the low temperature heat exchange and upstream from the high-temperature heat exchange; and an expansion process downstream from the high-temperature heat exchange and upstream from the low temperature heat exchange. Also, the generating cycle further comprises: exchanging heat between the working fluid and a first high-temperature thermal reservoir; an expansion process downstream from the high temperature heat exchange and upstream from the low temperature heat exchange; and a compression process upstream from the high temperature heat exchange and downstream from the low temperature heat exchange.

In an eighth embodiment, the seventh embodiment further comprises recuperating heat from the working fluid in the charging cycle and in the generating cycle.

In a ninth embodiment, the first embodiment further comprises recuperating heat from the working fluid in the charging cycle and in the generating cycle.

In a tenth embodiment, a Pumped Thermal Energy Storage System ("PTES"), comprises: a first low-temperature thermal reservoir; a second low temperature thermal reservoir; and a working fluid circuit through which a working fluid is circulated in operation. The working fluid circuit includes, during a charging cycle, a first low-temperature heat exchanger that, in operation, transfers heat from the first low-temperature thermal reservoir to the working fluid, the first low-temperature thermal reservoir operating at a first temperature. During a generating cycle, the working fluid circuit includes a second low-temperature heat exchanger that, in operation, transfers heat from the working fluid to a second low-temperature thermal reservoir. The second low-temperature thermal reservoir exists independently of the first low-temperature thermal reservoir, is decoupled from the first low-temperature thermal reservoir, and operates at a second temperature less than the first temperature.

In an eleventh embodiment, the second temperature in the tenth embodiment is less than the first temperature by an amount exceeding about 5° C.

In a twelfth embodiment, the second temperature in the eleventh embodiment is about 15° C. less than the first temperature.

In a thirteenth embodiment, the working fluid of the tenth embodiment is Carbon dioxide (CO2).

In a fourteenth embodiment, the first low-temperature reservoir of the tenth embodiment is a waste heat source while the second low-temperature reservoir is an ambient atmosphere.

In a fifteenth embodiment, the tenth embodiment further comprises a control system programmed to configuring the working fluid circuit for the charging cycle and for the generating cycle.

In a sixteenth embodiment, the control system of the fifteenth embodiment comprises: a plurality of fluid flow valves; a processor-based resource; and a memory. On the memory resides a plurality of instructions that, when executed by the processor-based resource, cause the processor-based resource to configure the working fluid circuit for the charging cycle and the generating cycle.

In a seventeenth embodiment, the working fluid circuit of the tenth embodiment further includes, during the charging cycle: a high temperature heat exchange between the working fluid and a first high-temperature thermal reservoir; a compression process downstream from the low temperature heat exchange and upstream from the high-temperature heat exchange; and an expansion process downstream from the high-temperature heat exchange and upstream from the low temperature heat exchange. During the generating cycle, the working fluid circuit includes: a high temperature heat exchange between the working fluid and a first high-temperature thermal reservoir; an expansion process downstream from the high temperature heat exchange and upstream from the low temperature heat exchange; and a compression process upstream from the high temperature heat exchange and downstream from the low temperature heat exchange.

In an eighteenth embodiment, the seventeenth embodiment further comprises a recuperator recuperating heat from the working fluid in the charging cycle and in the generating cycle during operation.

In a nineteenth embodiment, the high-temperature thermal reservoir of the seventeenth embodiment is a contained reservoir containing a thermal medium selected from the group comprising sand or gravel, concrete, encapsulated phase-change materials, bulk phase-change materials, or a combination thereof.

In a twentieth embodiment, the tenth embodiment further comprises a recuperator recuperating heat from the working fluid in the charging cycle and in the generating cycle during operation.

In a twenty-first embodiment, A Pumped Thermal Energy Storage System ("PTES") is as shown and described above.

In a twenty-second embodiment, method for use in a Pumped Thermal Energy Storage System ("PTES") is as shown and described.

Further, as used herein, the article "a" is intended to have its ordinary meaning in the patent arts, namely "one or more." Herein, the term "about" when applied to a value generally means within the tolerance range of the equipment used to produce the value, or in some examples, means plus or minus 10%, or plus or minus 5%, or plus or minus 1%, unless otherwise expressly specified. Further, herein the term "substantially" as used herein means a majority, or almost all, or all, or an amount with a range of about 51% to about 100%, for example. Moreover, examples herein are intended to be illustrative only and are presented for discussion purposes and not by way of limitation.

Examples in the present disclosure may also be directed to a non-transitory computer-readable medium storing computer-executable instructions and executable by one or more processors of the computer via which the computer-readable medium is accessed. A computer-readable media may be any available media that may be accessed by a computer. By way of example, such computer-readable media may comprise random access memory ("RAM"); read-only memory ("ROM"); electrically erasable, programmable, read-only memory ("EEPROM"); compact disk read only memory ("CD-ROM") or other optical disk storage, magnetic disk storage or other magnetic storage devices, or any other medium that may be used to carry or store desired program code in the form of instructions or data structures and that may be accessed by a computer. Disk and disc, as used herein, includes compact disc ("CD") laser disc, optical disc, digital versatile disc ("DVD"), floppy disk and Blu-ray® disc where disks usually reproduce data magnetically, while discs reproduce data optically with lasers.

Note also that the software implemented aspects of the subject matter claimed below are usually encoded on some form of program storage medium or implemented over some type of transmission medium. The program storage medium is a non-transitory medium and may be magnetic (e.g., a floppy disk or a hard drive) or optical (e.g., a compact disk read only memory, or "CD ROM"), and may be read only or random access. Similarly, the transmission medium may be twisted wire pairs, coaxial cable, optical fiber, or some other suitable transmission medium known to the art. The claimed subject matter is not limited by these aspects of any given implementation.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific examples are presented for purposes of illustration and description. They are not intended to be exhaustive of or to limit this disclosure to the precise forms described. Obviously, many modifications and variations are possible in view of the above teachings. The examples are shown and described in order to best explain the principles of this disclosure and practical applications, to thereby enable others skilled in the art to best utilize this disclosure and various examples with various modifications as are suited to the particular use contemplated. It is intended that the scope of this disclosure be defined by the claims and their equivalents below.

What is claimed is:

1. A method for use in a Pumped Thermal Energy Storage System ("PTES"), the method comprising:
- circulating a working fluid through a working fluid circuit; and
- operating the PTES through a charging cycle and a generating cycle while circulating the working fluid, in which:
  - during the charging cycle, transferring heat from a first low-temperature thermal reservoir to the working fluid, the first low-temperature thermal reservoir operating at a first temperature; and
  - during the generating cycle, transferring heat from the working fluid to a second low-temperature thermal reservoir, the second low-temperature thermal reservoir:
    - existing independently of the first low-temperature thermal reservoir;
    - being decoupled from the first low-temperature thermal reservoir; and
    - operating at a second temperature less than the first temperature.

2. The method of claim 1, wherein the second temperature is less than the first temperature by an amount exceeding about 5° C.

3. The method of claim 2, wherein the second temperature is about 15° C. less than the first temperature.

4. The method of claim 1, wherein the working fluid is Carbon dioxide ($CO_2$).

5. The method of claim 1, wherein:
- the first low-temperature reservoir is a waste heat source; and
- the second low-temperature reservoir is an ambient atmosphere.

6. The method of claim 1, further comprising configuring the working fluid circuit for the charging cycle and for the generating cycle.

7. The method of claim 1, wherein:
- the charging cycle further comprises:
  - exchanging heat between the working fluid and a first high-temperature thermal reservoir;
  - a compression process downstream from the low temperature heat exchange and upstream from the high-temperature heat exchange; and
  - an expansion process downstream from the high-temperature heat exchange and upstream from the low temperature heat exchange; and
- the generating cycle further comprises:
  - exchanging heat between the working fluid and a first high-temperature thermal reservoir;
  - an expansion process downstream from the high temperature heat exchange and upstream from the low temperature heat exchange; and
  - a compression process upstream from the high temperature heat exchange and downstream from the low temperature heat exchange.

8. The method of claim 7, further comprising recuperating heat from the working fluid in the charging cycle and in the generating cycle.

9. The method of claim 1, further comprising recuperating heat from the working fluid in the charging cycle and in the generating cycle.

10. A Pumped Thermal Energy Storage System ("PTES"), comprising:
- a first low-temperature thermal reservoir;
- a second low temperature thermal reservoir; and
- a working fluid circuit through which a working fluid is circulated in operation, the working fluid circuit including:
  - during a charging cycle, a first low-temperature heat exchanger that, in operation, transfers heat from the first low-temperature thermal reservoir to the working fluid, the first low-temperature thermal reservoir operating at a first temperature; and
  - during a generating cycle, a second low-temperature heat exchanger that, in operation, transfers heat from the working fluid to a second low-temperature thermal reservoir, the second low-temperature thermal reservoir:
    - existing independently of the first low-temperature thermal reservoir;
    - being decoupled from the first low-temperature thermal reservoir; and
    - operating at a second temperature less than the first temperature.

11. The PTES of claim 10, wherein the second temperature is less than the first temperature by an amount exceeding about 5° C.

12. The PTES of claim 11, wherein the second temperature is about 15° C. less than the first temperature.

13. The PTES of claim 10, wherein the working fluid is Carbon dioxide ($CO_2$).

14. The PTES of claim 10, wherein:
- the first low-temperature reservoir is a waste heat source; and
- the second low-temperature reservoir is an ambient atmosphere.

15. The PTES of claim 10, further comprising a control system programmed to configure the working fluid circuit for the charging cycle and for the generating cycle.

16. The PTES of claim 15, wherein the control system comprises:
- a plurality of fluid flow valves;
- a processor-based resource; and
- a memory on which resides a plurality of instructions that, when executed by the processor-based resource, cause the processor-based resource to configure the working fluid circuit for the charging cycle and the generating cycle.

17. The PTES of claim 10, wherein the working fluid circuit further includes:

during the charging cycle:

a high temperature heat exchange between the working fluid and a first high-temperature thermal reservoir;

a compression process downstream from the low temperature heat exchange and upstream from the high-temperature heat exchange; and an expansion process downstream from the high-temperature heat exchange and upstream from the low temperature heat exchange; and during the generating cycle:

a high temperature heat exchange between the working fluid and a first high-temperature thermal reservoir;

an expansion process downstream from the high temperature heat exchange and upstream from the low temperature heat exchange; and a compression process upstream from the high temperature heat exchange and downstream from the low temperature heat exchange.

18. The PTES of claim 17, further comprising a recuperator recuperating heat from the working fluid in the charging cycle and in the generating cycle during operation.

19. The PTES of claim 17, wherein the high-temperature thermal reservoir is a contained reservoir containing a thermal medium selected from the group comprising sand or gravel, concrete, encapsulated phase-change materials, bulk phase-change materials, or a combination thereof.

20. The PTES of claim 10, further comprising a recuperator recuperating heat from the working fluid in the charging cycle and in the generating cycle during operation.

* * * * *